US011643908B1

(12) United States Patent
Williams et al.

(10) Patent No.: US 11,643,908 B1
(45) Date of Patent: May 9, 2023

(54) AUTOMATED CONFIGURATION OF PUMPING EQUIPMENT

(71) Applicant: Halliburton Energy Services, Inc., Houston, TX (US)

(72) Inventors: Derek R. Williams, Duncan, OK (US); Charles E. Neal, III, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 17/518,869

(22) Filed: Nov. 4, 2021

(51) Int. Cl.

| | |
|---|---|
| ***E21B 41/00*** | (2006.01) |
| ***E21B 43/12*** | (2006.01) |
| ***E21B 34/00*** | (2006.01) |
| *E21B 43/26* | (2006.01) |

(52) U.S. Cl.
CPC ..... *E21B 41/00* (2013.01); *E21B 34/00* (2013.01); *E21B 43/12* (2013.01); *E21B 43/26* (2013.01)

(58) Field of Classification Search
CPC ..... E21B 47/10; E21B 34/00; E21B 34/06; E21B 41/00; E21B 43/12; E21B 47/06; E21B 43/26
See application file for complete search history.

(56) References Cited

U.S. PATENT DOCUMENTS

| | | | |
|---|---|---|---|
| 5,624,182 | A | 4/1997 | Dearing, Sr. et al. |
| 10,253,625 | B2 | 4/2019 | Williams et al. |
| 10,392,918 | B2 | 8/2019 | Harkless et al. |
| 11,002,269 | B2 | 5/2021 | Pal et al. |
| 2003/0072208 | A1 | 4/2003 | Rondeau et al. |
| 2006/0052903 | A1 | 3/2006 | Bassett |
| 2012/0025997 | A1 | 2/2012 | Liu et al. |

(Continued)

FOREIGN PATENT DOCUMENTS

| | | | |
|---|---|---|---|
| CN | 110838155 | A | 2/2020 |
| CN | 210402440 | U | 4/2020 |

(Continued)

OTHER PUBLICATIONS

Foreign Communication from Related Application—International Search Report and Written Opinion of the International Searching Authority, International Application No. PCT/US2021/058720, dated Aug. 1, 2022, 12 pages.

(Continued)

*Primary Examiner* — Brad Harcourt
(74) *Attorney, Agent, or Firm* — Conley Rose, P.C.; Rodney B. Carroll

(57) ABSTRACT

A method of configuring a flow control valve of a mixing system may comprise establishing a flow loop via a pump, a flow control valve, and a flow rate sensor. The method may also include performing a valve configuration process that includes positioning the flow control valve in a first position, operating the pump to communicate a fluid via the flow loop at a first speed, measuring a first periodic dataset while the fluid is communicated via the flow loop, and recording the first periodic dataset. The method may also include comparing a result of the valve configuration process to a valve position dataset and an operational indicator set and determining an pass/fail status based upon the comparison, and outputting, by the unit controller, indicia of the pass/fail status of the mixing system via the input output device.

21 Claims, 8 Drawing Sheets

(56) References Cited

U.S. PATENT DOCUMENTS

| | | | | |
|---|---|---|---|---|
| 2016/0076322 | A1* | 3/2016 | Oddie | E21B 21/10 73/152.51 |
| 2017/0002644 | A1 | 1/2017 | Chen et al. | |
| 2017/0308805 | A1* | 10/2017 | Altamirano | E21B 47/00 |
| 2018/0266198 | A1* | 9/2018 | Manum | G01F 1/74 |
| 2019/0317488 | A1 | 10/2019 | Al-Maghlouth et al. | |
| 2020/0103889 | A1 | 4/2020 | Cella et al. | |
| 2020/0191130 | A1 | 6/2020 | Van Der Spek et al. | |
| 2020/0355067 | A1 | 11/2020 | Williams et al. | |
| 2020/0362664 | A1 | 11/2020 | Urdaneta et al. | |
| 2022/0065099 | A1* | 3/2022 | Johnson | E21B 21/001 |

FOREIGN PATENT DOCUMENTS

| | | | |
|---|---|---|---|
| CN | 212272574 | U | 1/2021 |
| EP | 1485574 | B1 | 11/2007 |
| KR | 20170030823 | A | 3/2017 |
| KR | 20180044086 | A | 5/2018 |
| KR | 20200075229 | A | 6/2020 |
| WO | 2016160459 | A2 | 10/2016 |
| WO | 2021050943 | A1 | 3/2021 |

OTHER PUBLICATIONS

Foreign Communication from Related Application—International Search Report and Written Opinion of the International Searching Authority, International Application No. PCT/US2021/060309, dated Aug. 9, 2022, 12 pages.

Filing Receipt, Specification and Drawings for U.S. Appl. No. 17/529,061, entitled "Predictive Pump Maintenance Based Upon Utilization and Operating Conditions," filed Dec. 2, 2021, 78 pages.

Electronic Acknowledgement Receipt, Specification and Drawings for International Application No. PCT/US2021/60309, entitled "Predictive Pump Maintenance Based Upon Utilization and Operating Conditions," filed Nov. 22, 2021, 57 pages.

Electronic Acknowledgement Receipt, Specification and Drawings for U.S. Appl. No. 17/518,867, entitled "Automated Mix Water Test," filed Nov. 18, 2021, 68 pages.

Electronic Acknowledgement Receipt, Specification and Drawings for International Patent Application No. PCT/US2021/58718, entitled "Automated Mix Water Test," filed Nov. 10, 2021, 68 pages.

Filing Receipt, Specification and Drawings for U.S. Appl. No. 17/486,400, entitled "Cementing Unit Power On Self Test," filed Oct. 8, 2021, 64 pages.

Electronic Acknowledgement Receipt, Specification and Drawings for International Patent Application No. PCT/US2021/58720, entitled "Automated Configuration of Pumping Equipment," filed Nov. 10, 2021, 84 pages.

Foreign Communication from Related Application—International Search Report and Written Opinion of the International Searching Authority, International Application No. PCT/US2021/058718, dated Jul. 26, 2022, 12 pages.

* cited by examiner

AUTOMATED CONFIGURATION OF PUMPING EQUIPMENT

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In oil and gas wells a primary purpose of a barrier composition such as cement or a sealant is to isolate the formation fluids between zones, also referred to as zonal isolation and zonal isolation barriers. Cement is also used to support the metal casing lining the well, and the cement provides a barrier to prevent the fluids from damaging the casing and to prevent fluid migration along the casing.

Typically, an oil well is drilled to a desired depth with a drill bit and mud fluid system. A metal pipe (e.g., casing, liner, etc.) is lowered into the drilled well to prevent collapse of the drilled formation. Cement is placed between the casing and formation with a primary cementing operation. One or more downhole tools may be connected to the casing to assist with placement of the cement.

In a primary cementing operation, a cement blend tailored for the environmental conditions of the wellbore is pumped into the wellbore. This pumping operation may utilize pumping equipment, which may include a plurality of components controlled by a controller such as valves and pumps. Blending a slurry, meeting desired parameters, to be pumped downhole may depend the equipment being precisely configured. Personnel may perform a diagnostic test of one or more of these components before a job, although the data generated about the operation of these components is not necessarily conclusive as to the current configuration of those components for the intended job, nor is the data necessarily indicative of the operational condition of the equipment. An improved method of configuring the specialized pumping equipment for wellsite operations is needed.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 8A is a block diagram of an exemplary communication system according to an embodiment of the disclosure.

DETAILED DESCRIPTION

Figure 1:
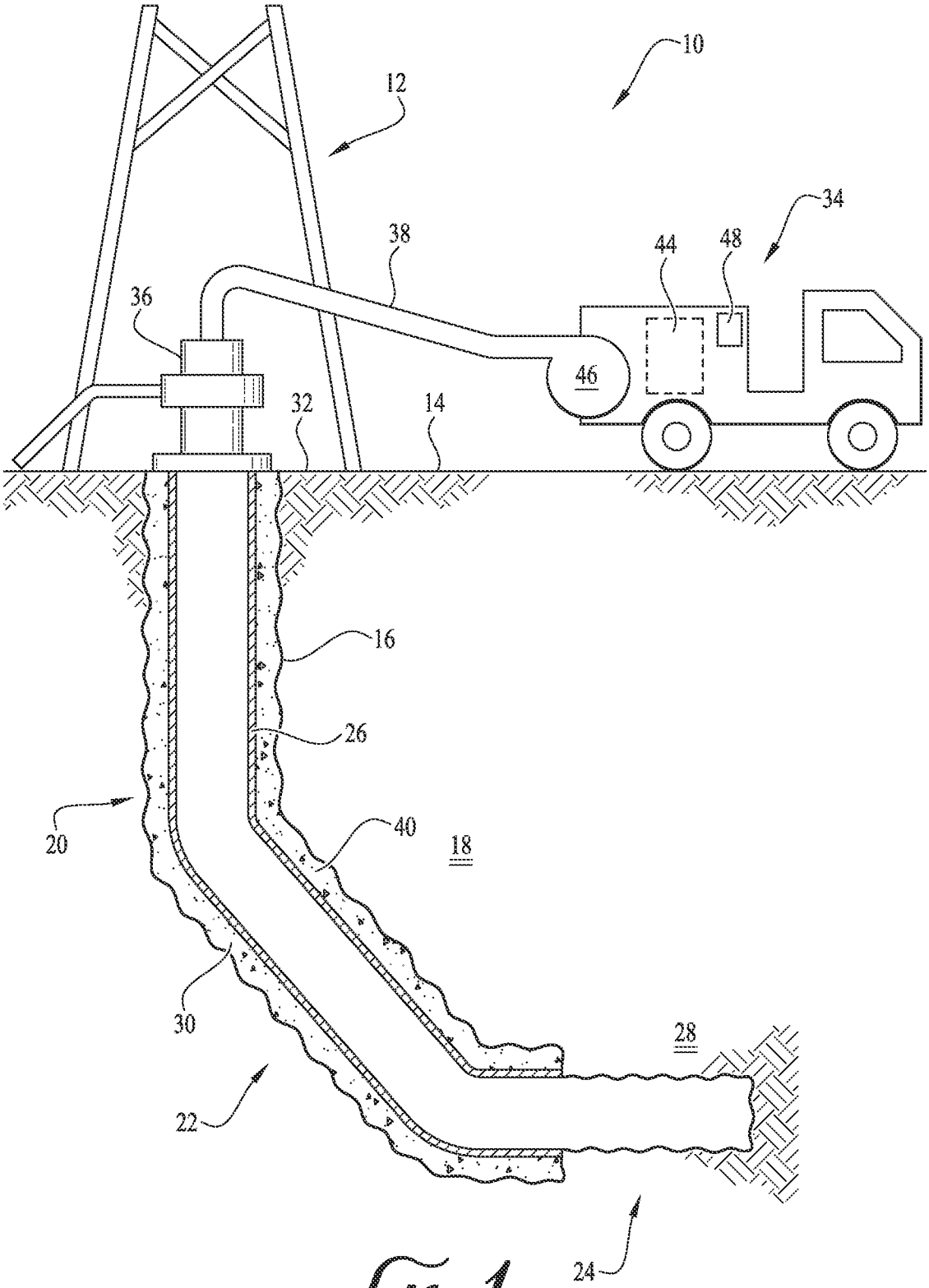
FIG. 1 is an illustration of an operating environment at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Oil well construction can follow a series of construction stages including drilling, cementing, completion or stimulation. Each stage can be carried out using specialized equipment and materials to carry out a series of steps to complete each stage.

Examples of the equipment that may be used at these stages include various configurations, types, and/or sizes of pumping equipment. For example, during the drilling stage, an oil well can be drilled with a drill bit, a mud system, and a mud pump. As the drill bit penetrates the earth strata, a drilling mud is pumped down a drill string to bring cuttings back to the surface, an example of which includes a reciprocating (e.g., plunger-type) pump. The mud pumping equipment may include a mixing system for blending dry mud blend with a liquid, e.g., water, to produce a mud slurry.

Also, for example, during the cementing stage, a cement pump may be used to introduce a cementitious slurry, e.g., a cement composition, into the annulus formed between the casing and the wellbore. The cement typically used for cementing oil wells can be a Portland cement comprised of a hydraulic cement with a source of free lime and alkali ions, a source of calcium carbonate, a source of calcium sulfate and an organic component. The mixing system can blend the dry cement with water to produce the cement slurry.

In another example, during the completion and/or stimulation stage, a blender and high pressure pump may be used to fracture a formation with a proppant slurry. The blender, also referred to as a blender unit, may include a mixing system for blending proppant, e.g., sand, and water with various additives, e.g., friction reducers, to produce the proppant slurry. The high pressure pumps, also referred to as fracturing units, may deliver the proppant slurry into the wellbore with sufficient pressure to fracture the formation and deposit the proppant into the fractures.

The pumping equipment used at various well construction stages may include one or more valves communicatively coupled to a unit controller. A valve may be actuated, e.g., opened or closed, by rotating a valve stem, for example, to change the configuration of the valve between an open position, a closed position, and or various intermediate positions. A valve actuator may be mechanically coupled to the stem of the valve and may be actuated by the unit controller, for example, with feedback from one or more valve position sensors. The rotational position of the valve stem when the valve yields a particular configuration, for example, when the valve is in the open position, the closed position, or a particular intermediate position, may change due to valve maintenance, erosion of the valve assembly, seal degradation, environmental factors, or combination thereof. Service personnel can perform diagnostic tests on the valves of the mixing system before or after a job, however, in some cases the diagnostic tests can be inconclusive and/or service personnel may not recognize data indicative of present or forthcoming problems. Additionally or alternatively, the service personnel may fail to record or submit the diagnostic test results for evaluation. As such, an improved method of performing a valve configuration process is needed.

In an embodiment, a system for configuring a valve can include a unit controller associated with the valve that executes a process to perform a valve configuration. The process can execute a diagnostic method, for example, a diagnostic test, on the valve by causing components of the mixing system to perform a predetermined routine while automatically logging the results. In an embodiment, the predetermined routine may comprise a flowrate test performed on the mixing system. For example, the process may cause the mixing system to perform steps that include setting a valve position, operating a pump such that a fluid is communicated through one or more components of the mixing system at one or more predetermined flowrates, and recording data from sensors during communication of the fluid. The predetermined routine may iterate, make small changes to the valve position, to determine if the valve position value saved in memory needs to be adjusted, e.g., replaced with a new valve position value. The data from the sensors can be logged into data storage location on the unit controller and, optionally, displayed on Human Machine Interface (HMI), e.g., a display. The data may be subjected to processing to yield results indicative of the function of the valve. For example, the results may indicate that the flow control valve is operating nominally, that the positional values of the flow control valve are not aligned with the valve position and make the adjustment, e.g., replace the positional values, or that the flow control valve needs maintenance. The results may be displayed on the control display as a curve, a table, a simple pass or fail, or combination thereof. The valve configuration process can save time, report needed maintenance, increase reliability, and improve the data reporting.

Additionally or alternatively, in an embodiment the unit controller can cause the data and/or results to be wirelessly communicated between the system and a remote location, for example, a remote service center. For example, in an embodiment, the unit controller may comprise or be communicatively coupled to a wireless communication assembly capable of wireless communication with the remote service center, such as through a mobile network. In some embodiments, the data can be transmitted to the remote service center for processing to yield the results indicative of the configuration of the valve. Additionally or alternatively, in some embodiments the results of the flowrate test can be transmitted to the remote location, for example, a data storage location and/or the remote service center, for recordation. The unit controller may automatically report the results of the valve configuration at the end of the test.

FIG. 1 illustrates a wellsite environment 10, according to one or more aspects of the presently-disclosed subject matter. The wellsite environment 10 comprises a drilling or servicing rig 12 that extends over and around a wellbore 16 that penetrates a subterranean formation 18 for the purpose of recovering hydrocarbons. The wellbore 16 can be drilled into the subterranean formation 18 using any suitable drilling technique. While shown as extending vertically from the surface 14 in FIG. 1, the wellbore 16 can also be deviated, horizontal, and/or curved over at least some portions of the wellbore 16. For example, the wellbore 16, or a lateral wellbore portion of the wellbore 16, can have a vertical portion 20, a deviated portion 22, and a horizontal portion 24. Portions or all of the wellbore 16 can be cased, open hole, or combination thereof. For example, a first portion extending from the surface can contain a string of casing 26 and a second portion can be a wellbore drilled into a subterranean formation 28. A primary casing string 26 can be placed in the wellbore 16 and secured at least in part by cement 30.

The servicing rig 12 can be one of a drilling rig, a completion rig, a workover rig, or other structure and supports operations in the wellbore 16. The servicing rig 12 can also comprise a derrick, or other lifting means, with a rig floor 32 through which the wellbore 16 extends downward from the servicing rig 12. In some cases, such as in an off-shore location, the servicing rig 12 can be supported by piers extending downwards to a seabed. Alternatively, the servicing rig 12 can be supported by columns sitting on hulls and/or pontoons that are ballasted below the water surface, which can be referred to as a semi-submersible platform or floating rig. In an off-shore location, a casing can extend from the servicing rig 12 to exclude sea water and contain drilling fluid returns.

In an embodiment, the wellbore 16 can be completed with a cementing process by way of which a cement 30 is disposed in an annular space 40 between the casing string 26 and the wellbore 16. A pump unit 34, also called cement pumping equipment 34, can be fluidically connected to a wellhead 36 by a supply line 38. The wellhead 36 can be any type of pressure containment equipment connected to the top of the casing string 26, such as a surface tree, production tree, subsea tree, lubricator connector, blowout preventer, or combination thereof. The wellhead 36 can anchor the casing string 26 at surface 14. The wellhead 36 can include one or more valves to direct the fluid flow from the wellbore and one or more sensors that gather pressure, temperature, and/or flowrate data. In operation, the pump unit 34 can pump a volume of cementitious slurry, which may be specifically tailored to the wellbore, though the supply line 38, through the wellhead 36, down the casing string 26, and into the annular space 40.

The cement 30 can be Portland cement or a blend of Portland cement with various additives to tailor the cement for the wellbore environment. For example, retarders or accelerators can be added to the cementitious slurry to slow down or speed up the curing process. In some embodiments, the cement 30 can include a polymer designed for high temperatures. In some embodiments, the cementitious slurry can include additives such as fly ash to change the density, e.g., decrease the density, of the cementitious slurry.

The pump unit 34, also referred to as a wellbore pump unit, may include mixing equipment 44, pumping equipment 46, and a unit controller 48. The mixing equipment 44 can be in the form of a jet mixer, recirculating mixer, a batch mixer, a single tub mixer, or a dual tub mixer with a mixing device and a liquid delivery system. The mixing equipment 44 can combine a dry ingredient, e.g., cement, with a liquid, e.g., water, for pumping via the pumping equipment 46 into the wellbore 16. The liquid delivery system comprises a supply pump, a flow control valve, and sensors. The pumping equipment 46 can be a centrifugal pump, piston pump, or a plunger pump. The unit controller 48 may establish control of the operation of the mixing equipment 44 and the pumping equipment 46. The unit controller 48 can operate the mixing equipment 44 and the pumping equipment 46 via one or more commands received from the service personnel as will be described further herein. Although the pump unit 34 is illustrated as a truck, it is understood that the pump unit 34 may be skid mounted or trailer mounted. Although the pump unit 34 is illustrated as a single unit, it is understood that there may be 2, 3, 4, or any number of pump units 34 fluidically coupled to the wellhead 36, for example, via a fluid manifold.

Although the embodiment of FIG. 1 describes the wellsite environment 10 in the context of a cementing operation, in an additional or alternative embodiment, for example, in the context of a drilling or completion operation, a pump unit similarly-situated to the pump unit 34 of FIG. 1 can be a mud pump fluidically connected to the wellbore 16 by the supply line 38 to pump drilling mud slurry or a water based fluid such as a completion fluid, e.g., a completion brine, into the wellbore 16. Mixing equipment 44 may similarly be employed to blend or mix a dry mud blend with a fluid such as water or oil-based fluid. The pumping equipment 46 may include a piston pump or other suitable type or configuration. The drilling mud slurry or the completion brine may be referred to as a wellbore treatment.

In an alternate embodiment, for example, in the context of a completion operation, a pump unit similarly situated to the pump unit 34 of FIG. 1 can be a blender fluidically connected to one or more high pressure pumping units, also called frac pumps, that are fluidically connected to the wellbore 16 by the supply line 38 to pump a wellbore treatment, e.g., frac slurry, into the wellbore 16. Mixing equipment like the mixing equipment 44 of FIG. 1 may similarly be employed to blend or mix a proppant, e.g., sand, with a water mixture that includes one or more additives, e.g., a friction reducer or a gel, into the frac slurry. The pumping equipment 46 may be a centrifugal pump or a plunger pump. Although one pump unit 34 is illustrated in FIG. 1, it is understood that two or more pump units may be coupled to the wellbore 16 and communicatively coupled by the unit controller 48 to cooperatively pump a wellbore treatment into the wellbore 16. For example, a blender may be fluidically coupled to wellhead 36 via a frac pump. The blender and the frac pump may be communicatively coupled by the unit controller 48.

Figure 2:
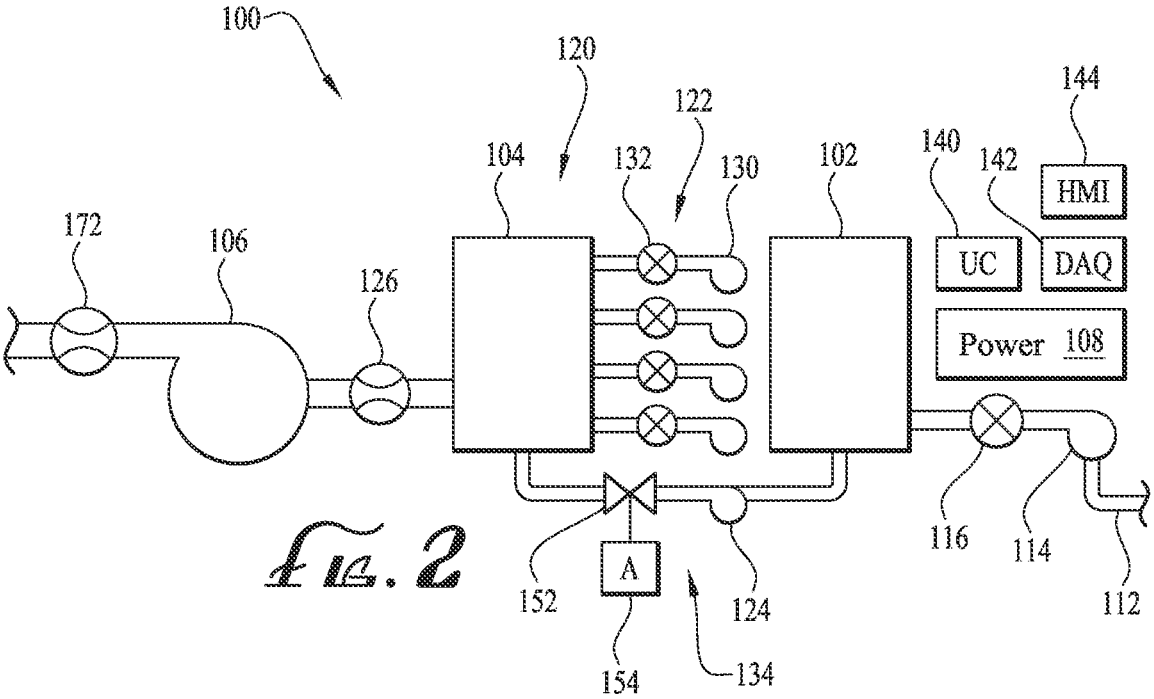
FIG. 2 is an illustration of a pump unit assembly according to an embodiment of the disclosure.

Referring to FIG. 2, a particular embodiment of the pump unit 34 is illustrated in further detail as pump unit 100. In the embodiment of FIG. 2, the pump unit 100 comprises a supply tank 102, a mixing system 120, a main pump 106, and at least one power supply 108. The main pump 106 can be a centrifugal pump. The power supply 108 can include one or more electric-, gas-, or diesel-powered motors which are coupled to the supply tank 102, the mixing system 120, the main pump 106, and the various components such as feed pumps and valves. The power supply 108 may supply power to actuate the main pump 106. For example, the power supply 108 can be directly coupled by a drive shaft or indirectly coupled, such as via an electrical power supply, to the main pump 106. The mixing system 120 can blend a fluid composition of water, dry ingredients, e.g., cement, mud, or sand, and other additives for delivery to the wellbore 16 via the main pump 106.

The pump unit 100 may comprise a unit controller 140, a data acquisition system (DAQ) card 142, and a display 144. The unit controller 140 may comprise a computer system comprising one or more processors, memory, input devices, and/or output devices. The unit controller 140 may have one or more applications executing in memory and configured to carry out one or more of the methods or protocols disclosed herein, or a portion thereof. The unit controller 140 may be communicatively connected to the pumping equipment and mixing equipment of the pump unit 34. The DAQ card 142 may convert one or more analog and/or digital signals into signal data. In various embodiments, the DAQ card 142 may be a standalone system with a microprocessor, memory, and one or more applications executing in memory, or may be combined or incorporated with the unit controller 140 into a unitary assembly. For example, the DAQ card 142 may be combined with one of the input output devices of the unit controller 140 when combined into a unitary assembly. The display 144, e.g., interactive display, may be a suitable configuration of Human Machine Interface (HMI) that provides an input device and an output device for the unit controller 140. Additional or alternative may also be used. The display 144 may include a selectable input screen that includes icons and selectable key board or key pad inputs for the unit controller 140. The display 144 may display data and information about the status and operation of the pump unit 100 to a user, including data from the DAQ card 142.

The supply tank 102 can store a volume of water or other liquid and provide the water or liquid for use in the mixing system 120. The supply tank 102 can be connected to a water supply unit by a supply line 112, a supply pump 114, and a supply valve 116. The supply pump 114 can comprise a centrifugal pump, a piston pump, or a plunger pump. The supply valve 116 can comprise a flow control valve, e.g., a globe valve, a pinch valve, or a needle valve, that can be open, closed, or regulate the fluid flow within. The unit controller 140 may provide power, e.g., voltage and current, and/or a control signal to the supply valve 116 and the supply pump 114. The supply tank 102 may have one or more sensors, e.g., a tub level sensor, communicatively connected to the unit controller 140 via the DAQ card 142.

The mixing system 120 can include the mixing drum 104, one or more additive systems 122, and a liquid delivery system 134. The liquid delivery system can fluidically connect the supply tank 102 to the mixing drum 104. The one or more additive systems 122 may fluidically connect a volume of liquid additives, such as accelerators, retarders, extenders, fluid loss, and viscosity modifiers, to the mix drum 104. The additive systems 122 can comprise an additive pump 130, an additive valve 132, and flow meter. The additive pump 130 can be a diaphragm pump, a piston pump, or a centrifugal pump. The additive valve 132 can be an on-off valve such as a ball valve or plug valve. Each additive pump 130 can be communicatively coupled to a corresponding flow meter and to the unit controller 140 via the DAQ card 142. The unit controller 140 can dispense a predetermined volume of additive by controlling the additive pump 130 and additive valve 132 with feedback from the flow meter. The liquid delivery system 134 can supply a predetermined flowrate of liquid, e.g., water, to the mix drum 104. The unit controller 140 may change the volumetric rate of the liquid, e.g., water, with the supply pump 124 and the valve position of the flow control valve 170 in response to the data from one or more sensors, e.g., flow meter. The mixing system 120 can include a mixing valve 126 located downstream from the mixing drum 104. The mixing valve 126 can be a flow control valve or an isolation valve, e.g., a ball valve or plug valve.

The liquid delivery system 134 comprises a supply pump 124 and a flow control valve 152. The flow control valve 152 can be a globe valve, a pinch valve, a needle valve, a plug valve, a ball valve, a slide valve, or combinations thereof. The flow control valves 152 may include a multi-turn actuation or a quarter turn actuation. The multi-turn actuation type may require multiple rotations of a handle, stem, or actuator to close the flow control valve 152. The quarter turn actuation may require approximately 90 degrees of rotation of the handle, stem, or actuator to close. A valve actuator 154 may be mechanically coupled to the stem of the valve. The term stem refers to a component of the valve assembly that couples the valve actuator 154 to the isolation member of the valve assembly. Rotational movement of the stem can control or manipulate the position value, e.g., 55% open, of the isolation member of the valve. The valve actuator 154 may be actuated by the unit controller 140 with feedback from one or more valve position sensors. The valve position sensors may be coupled with the valve actuator, the stem of the valve, the isolation member, or a combination thereof. The valve actuator may move the stem with rotational movement measured in degrees, percentage of a position, radians, a polar coordinate system, or combination thereof. For example, the valve actuator may move the stem 15 degrees to a 50% open position. The term position value may be the measured position or change in position. The supply pump 124 can be a centrifugal pump, a plunger pump, a screw pump, a piston pump, or combinations thereof. The unit controller 140 can direct the liquid delivery system 134 to pump water at a desired flowrate from the supply tank 102 to the mix drum 104 with various sensors providing feedback. In an embodiment, the liquid delivery system 134 can pump water from a supply line 112 connected to a water supply unit.

The main pump 106 can be configured according to the operation in which it will be employed. For example, the main pump 106 may be a centrifugal pump, a piston pump, or a plunger pump. For example, in the context of a cementing operation, the main pump 106 can be a centrifugal pump. The slurry mixed within the mixing drum 104 can be transferred to the main pump 106 via the mixing valve 126. The main pump 106 may have a main valve 172 coupled to the outlet of the main pump 106. The main valve 172 may be a stand-alone valve or may be a portion of a discharge manifold. A discharge manifold may have one or more flow valves and one or more isolation valves. The main valve 172 can be a flow control valve or an isolation valve such as a plug valve or ball valve. The unit controller 140 may be communicatively coupled to the main pump 106 and the main valve 172. The unit controller 140 may control the operation of the main pump 106 to change the pump rate of the main pump 106 and the valve position of the main valve 172 in response to the data from one or more sensors, e.g., a flow meter.

Although the pump unit 100 of FIG. 2 is described as a cement pumping unit, it is understood that the pump unit 100 may be a mud pump, a blender, a frac pump, or a water supply. Each type or configuration of pump unit, e.g., a mud pump, a cement pump unit, a blender, a frac pump, or a water supply, may include a main pump, e.g., 106, a flow control valve, e.g., 152, and a unit controller, e.g., 140. The unit controller, e.g., 140, may receive data via a DAQ card 142. The unit controller 140 of the pump unit, e.g., 100, may be communicatively connected to one or more pump units, e.g., 100, at the wellsite. The pump unit, e.g., 100, may work in concert with at least one more pump unit, e.g., 100. In a scenario, the pump unit 100 may be controlled, via the unit controller 140, by a control system at the wellsite. The pump unit 100 may be communicatively connected to a control system at the wellsite.

In some embodiments, a wellbore servicing method may include providing a wellbore treatment, via a pump unit, following a prescribed pumping procedure for the placement of the wellbore treatment at a target location within the wellbore. The wellbore treatment placed in the performance of the pumping procedure can include a treatment blend, e.g., cement blend, a liquid blend, e.g., water with additives, or combinations thereof and may be placed via one or more downhole tools. The liquid and/or treatment blend may be prepared within the pump unit, e.g., 34 of FIG. 1, as a wellbore treatment, e.g., a cementitious slurry. The pump unit, e.g., 34 of FIG. 1, can mix the treatment blend and the liquid blend within the mixing equipment, e.g., 44 of FIG. 1, to form a treatment slurry and pump the treatment slurry into the wellbore 16 with the pumping equipment 46 via the supply line 38. The pump unit 34 can deliver the treatment slurry into the wellbore 16 at a desired flowrate per the pumping procedure. Turning back to FIG. 2, the flowrate of the blended slurry from the pump unit 100 to the wellbore 16 can be controlled by the unit controller 140. The liquid delivery system 134 can transfer a liquid, e.g., water, from the supply tank 102 to the mixing drum 104 at a predetermined flowrate per the pumping procedure to create the blended slurry within the mixing system 120 for delivery to the wellbore 16 via the main pump 106. The proper blending of the wellbore treatment may depend on precise delivery of the liquid to the mixing equipment by the liquid delivery system 134. The ability of the mixing system 120 to blend the wellbore treatment can include the configuration of the flow control valve 152 of the liquid delivery system 134.

In an embodiment, the wellbore servicing method may comprise transporting the pump unit, e.g., 34 of FIG. 1, to the wellsite environment 10. The pump unit 34 may be positioned at the wellsite and fluidically connected to the wellbore 16, for example, via a high pressure line 38 coupled to a wellhead 36.

The unit controller of the pump unit, e.g., 34 of FIG. 1, may initiate a valve configuration process as part of a startup procedure, from a system prompt, or when initiated by service personnel. The startup procedure may be automatically run or given as an option. The system prompt may be generated by the unit controller or remotely. The service personnel may initiate the valve configuration process by starting up the unit controller.

In some embodiments, the unit controller may configure the valve positions with an valve configuration process that runs when prompted by the service personnel. In an embodiment, the service personnel may initiate a valve configuration process on the unit controller, e.g., 140 in FIG. 2, as part of a pump unit start up procedure or a pump unit shut down procedure. The start-up procedure may comprise one or more diagnostic procedures including the valve configuration process to determine the readiness of the pump unit 100. In a context, the valve configuration process may include an application. The pump unit shut down procedure may comprise one or more diagnostic procedures to determine if a change to the service operational capacity occurred during the performance of the job.

In an alternate embodiment, the unit controller may configure the valve positions with a valve configuration process that runs when the unit controller is turned on. For example, startup process of the pump unit may include a plurality of diagnostic tests and/or procedures that includes the valve configuration process.

In some embodiments, the unit controller may configure the valve positions with a valve configuration process that runs when prompted by a first diagnostic test. The service personnel may perform a first diagnostic test on the mix system 120 that comprises the flow control valve 152. The first diagnostic test may return an alert about the function of the flow control valve 152. For example, the service personnel may perform a first diagnostic test on the mix drum 104 that indicates a leak. Said another way, the mix drum 104 may not hold pressure within a predetermined amount of test time. The first diagnostic test may alert the service personnel to initiate the valve configuration process to check the proper function of the flow control valve 152.

In some embodiments, the unit controller may configure the valve positions with an valve configuration process that runs when prompted by a file status of the valve configuration file in memory. The file status may include a fail status or alert in response to a missing valve configuration file, a corrupted valve configuration file, or a valve configuration file that cannot be accessed because of a storage media corruption.

In some embodiments, the unit controller may configure the valve positions with an valve configuration process that runs when prompted by an alert within the valve configuration file in memory. A fail status may be generated in response to a time value exceeding a threshold value. The time value may comprise the amount of time, e.g., the number of minutes, hours, days, or combinations thereof, since the valve configuration process was activated.

In some embodiments, the unit controller may configure the valve positions with an valve configuration process that runs when prompted by a remote alert. An alert for the service personnel to initiate the valve configuration process may be communicated to the unit controller 140 from a remote user device, by a remote application, by a remote computer system, or combination thereof, to run the valve configuration process. For example, the service personnel can start up the pump unit, e.g., 100 in FIG. 2, and receive an alert on the interactive display 144 to run the valve configuration process.

The valve configuration process can align the valve position values accessed by the valve actuators to an angular position of the valve stem. In an embodiment, a valve position dataset can comprise a dataset of valve position values of the flow control valve 152, for example, comprising a relationship between an angular position of a valve stem of the flow control valve 152 and a position of the flow control valve 152. The unit controller 140 may actuate the flow control valve 152 with the valve actuator 154 per the valve position values of the valve position dataset. The valve position dataset may correlate an angular position of the valve actuator 154 to a value of a valve position. The valve position data set may comprise multiple values such as zero percent open (or 0% open), 25% open, 50% open, 100% open. For example, the valve position dataset may correlate an angular position 5.5 degrees with zero percent open, e.g., full closed and 95 degrees with 100% open, e.g., full open. Although four positions are listed, it is understood that the valve position dataset may comprise 1, 2, 3, 4, 5, 6, 7, 8, 9, 10, or any number of valve positions. The unit controller 140 may access the valve position dataset to change the flow control valve 152 from a first position to a second position via the valve actuator 154. The rotational position of the full open, e.g., 100%, full closed, 0% open, or any position between 100% to 0% open may change due to valve maintenance, erosion of the valve assembly, seal degradation, environmental factors, or combination thereof. For example, fluid may leak with the valve in the full closed position, e.g., zero percent open, due to a change in the property of the sealing material. In another scenario, the fluid flow past the valve may be reduced due to the valve not being full open, e.g., 100% open. The proper position value for the valve performance file saved in memory may be determined with a flowrate of water through the flow control valve 152 and the errant value may be replaced with a corrected value.

The valve configuration process may configure a flow loop, circulate water while logging measurements, assess the data, align the valve positions, and alert if there is an error or failure mode. The valve configuration process may configure a flow loop fluidically connected to the flow control valve 152. The supply pump 124 can circulate water through the flow control valve 152 while the unit controller iterates the position of the valve to establish full open or full closed position. The dataset measured by the sensors may be processed and assessed by the unit controller or remotely. The positional values for the full open and full closed position can be verified or realigned with a measured positional value. The valve position dataset of the flow control valve can be updated with the measured positional values. The measured dataset can be compared with one or more operational indicators and failure modes to determine an error or failure mode. The unit controller can display an indicia of the status of the valve configuration on the display.

Figure 3:
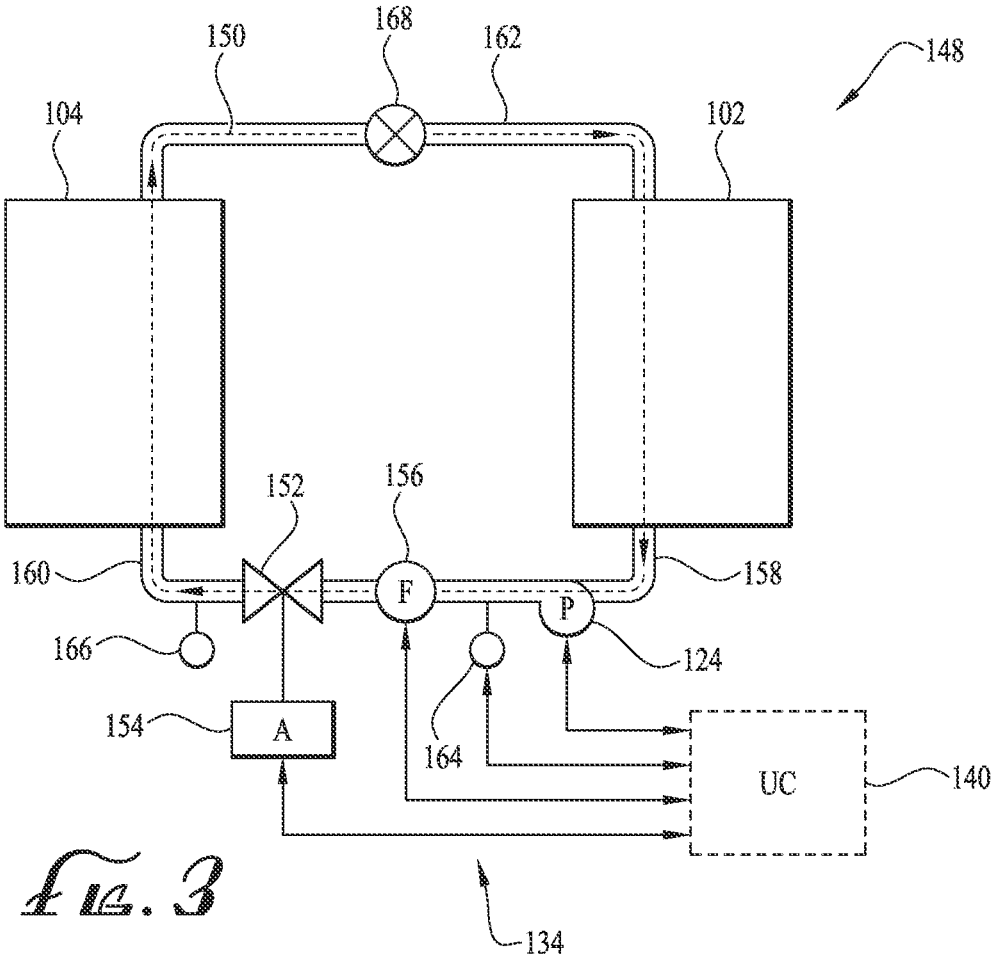
FIG. 3 is an illustration of an automated flow loop environment subject to diagnostic testing according to an embodiment of the disclosure.

The unit controller 140 may configure the flow control valve 152 with a valve configuration process. In an embodiment, a valve configuration process may generate a measured valve position value by pumping water from the supply tank 102 through a flow control valve 170 while logging the flowrate with a flowrate sensor. Turning now to FIG. 3, an automated flow loop environment is described. In some embodiments, the valve configuration process may establish a flow loop 150 with a volume of water within the pump unit, e.g., 100 of FIG. 2, by opening or closing each of a plurality of valves. For example, in FIG. 2, the valve configuration process can close the mixing valve 126, the supply valve 116, and the plurality of additive valves 132 of the additive systems 122. Returning to FIG. 3, the flow loop 150 can be completed by opening an isolation valve 168 on a return line 162 from the mixing drum 104 and the supply tank 102 and opening a flow control valve 152 on the supply line 158 from the supply tank 102 to the mixing drum 104. The return line 162 and the supply line 158 may comprise a portion of a larger manifold system of the pump unit 100. It is understood that in FIG. 3 the location of the supply line 158 and location of the return line 162 are illustrated for clarity and not the actual location. For example, the return line 162 may be located adjacent of the supply line 158 or vice versa. Although one valve is shown in the return line 162 and the supply line 158, it is understood that there may be 1, 2, 3, or any number of valves. The flow loop 150 includes some of the same components previously described in FIG. 2 and are thus labeled the same. The flow loop 150 comprises the supply tank 102, the supply line 158, the supply pump 124, the flow control valve 152, the mix drum 104, the return line 162, and the isolation valve 168. The supply line 158 can include a flowrate sensor 156, a first pressure sensor 164, and a second pressure sensor 166 communicatively connected to the unit controller 140. The flowrate sensor 156 may comprise a turbine type or Coriolis type flow meter.

In some embodiments, the valve configuration process may control pump unit 100 components to fill the flow loop 150. The valve configuration process may place water into the supply tank 102 and/or mixing drum 104 with water via the supply line 112 shown in FIG. 2. The valve configuration process may open the supply valve 116 and operate the supply pump 114 to fill the supply tank 102 and the mixing drum 104 until the tub level sensor in one or both locations senses a portion of the supply tank 102 or mixing drum 104 is filled with water. For example, the valve configuration process may fill the supply tank 102 and mixing drum 104 until the tub level sensor senses one or both tanks are 40%, 45%, 50%, 55%, 60%, or any portion of water between 15% and 100% of the filled capacity of the tubs. The unit controller 140 may stop the supply pump 114 and close the supply valve 116 such that the flow configuration illustrated in FIG. 3 is established or reestablished.

In some embodiments, the valve configuration process may control pump unit 100 components so as to determine a full open position of the flow control valve 152. The valve configuration process may direct the unit controller 140 to position the flow control valve 152 to a first position, for example, the full open position, e.g., 100% open, and operate the supply pump 124 at a first flow capacity, e.g., 100% flow capacity, also referred to as the rated operational capacity at the rated pump speed, of the supply pump 124. The water may travel in a circular path from the supply tank 102, into the supply line 158, through the supply pump 124, the flowrate sensor 156, the flow control valve 152, the mixing drum 104, into the return line 162, through the isolation valve 168, and back into the supply tank 102. It is understood that the supply line 158 and the return line 162 are at or approximately at the same height to minimize the pressure loss and/or pressure differentials due to the path of the flow loop 150. The valve configuration process on the unit controller 140 may monitor the flowrate data from the flowrate sensor 156 for a predetermined time period, e.g., 60 seconds, or until the data from the flowrate sensor is steady-state. The valve configuration process may record a periodic dataset comprising the pump speed (RPM), and the flowrate sensor, a valve position sensor, at least one pressure sensor, or combination thereof for a predetermined period of time. The valve configuration process may save the periodic dataset to a valve configuration file in a location in memory.

Figure 4A:
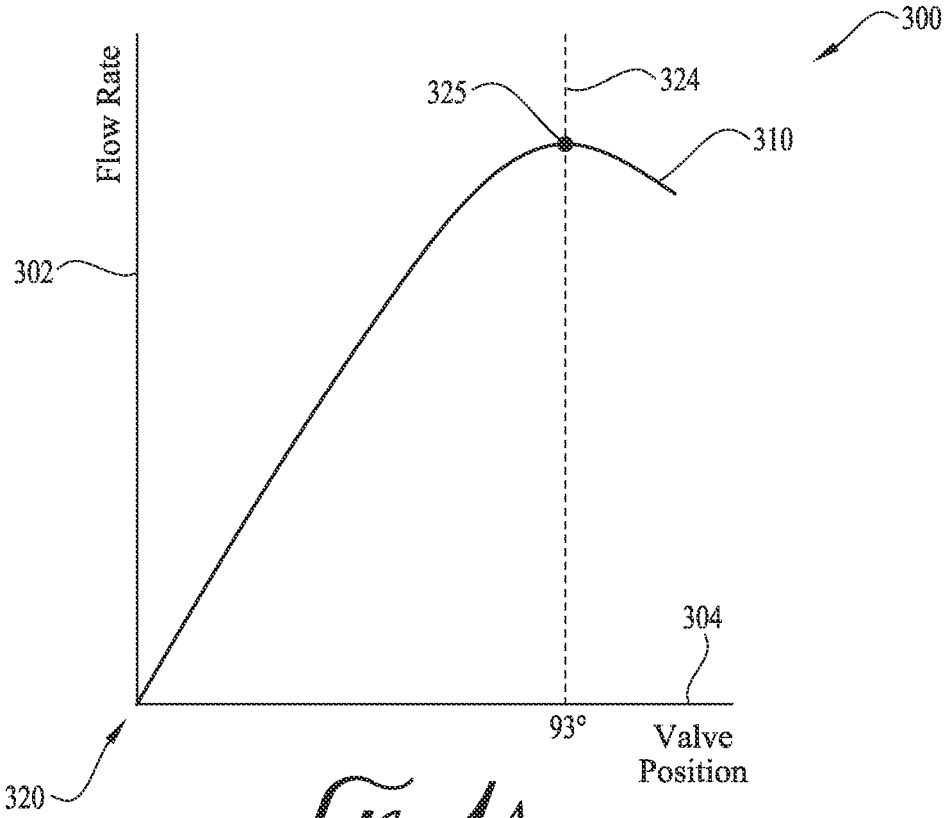
FIG. 4A is an illustration of a pump performance graph according to an embodiment of the disclosure.
Figure 4B:
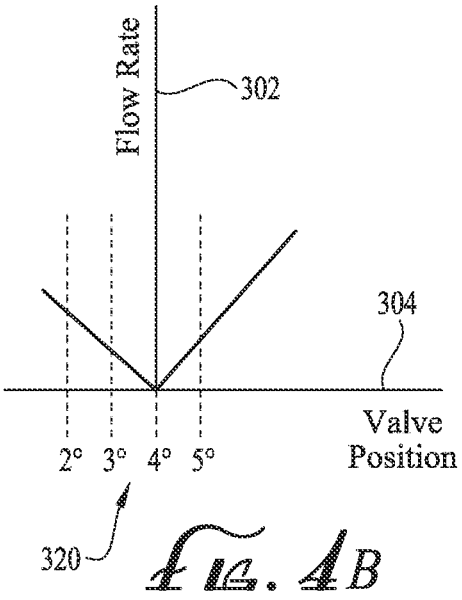
FIGS. 4B and 4C are illustrations of quadrants of a valve configuration graph according to an embodiment of the disclosure.
Figure 4C:
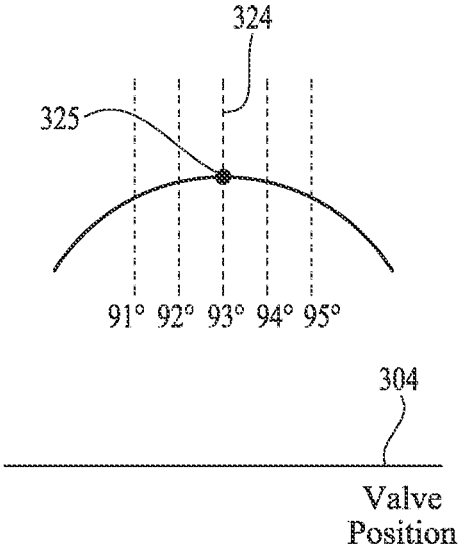

Turning now to FIG. 4C, the valve configuration process may iterate the position of the valve actuator 154 to move the flow control valve 152 to the full open position, e.g., 100% open. In the example shown in FIG. 4C, the valve position value saved in memory 180 may register a flowrate value on the y-axis 302 such as 95 degrees. The valve configuration process may record a periodic dataset from at least one sensor of the water moving through the valve coupled to the flow loop 150 illustrated in FIG. 3, such as the flowrate sensor 156, the first pressure sensor 164, the second pressure sensor 166, or combination thereof. The valve configuration process may iterate the valve position value by a decreasing the valve position value an incremental value. For example, the valve configuration process may iterate the valve position value from 95 degrees to 94 degrees. The valve configuration process may monitor the sensors for a sensor value indicative of flowrate increasing or decreasing through the valve, for example a change in the flowrate data, pressure data, or combination thereof. The valve configuration process can continue to iterate in a first direction if the flowrate is increasing. The valve configuration process can change from a first direction to a second direction if the flowrate is decreasing. For example, the valve configuration process may continue to iterate the valve position value in a first direction 94 degrees to 93 degrees as the sensor values are indicative of an increase in flowrate through the flow control valve 152. To continue the example, the valve configuration process may iterate in the first direction from 93 degrees to 92 degrees and then stop in response to detecting a decrease in flowrate. The valve configuration process may iterate in a second direction from 92 degrees to 93 degrees and monitor the sensor values for an increase in the flowrate of water through the flow control valve 152. The valve configuration process may save the periodic data to the valve configuration file. For example, the valve configuration process may write the value of the valve position to a valve configuration file. The valve configuration process may determine an error value by comparing the valve position value within the valve position dataset to the measured valve position value. The valve configuration process may write the error value to the valve configuration file and replace the valve position value within the valve position dataset with the measured valve position value within the valve configuration file. Although the change in valve position value is described in whole degrees, it is understood that the valve position value may be changed, e.g., iterated, in a portion of a degree, such as a fraction, e.g., %, or a decimal, e.g., 0.1.

The valve configuration process may iterate, or make small adjustments, to the position value of the valve to determine the full closed position value. Turning now to FIG. 4B, the valve configuration process may operate the supply pump 124 at full capacity, e.g., 100% pump speed, and actuate the valve actuator 154 to move the flow control valve 152 to the closed position, e.g., 0% open. In the example shown in FIG. 4B, the valve position value, illustrated as 4 degrees, within the valve position dataset may register a flowrate value on the y-axis 302. The valve configuration process may record a sensor value indicative of water moving through the valve from one or more sensors coupled to the flow loop 150 illustrated in FIG. 3, such as the flowrate sensor 156, the first pressure sensor 164, the second pressure sensor 166, or combination thereof. The valve configuration process may iterate the valve position value by a decreasing the valve position value an incremental value, e.g., a fraction of a degree, and record the periodic data. For example, the valve configuration process may iterate the valve position value from 3 degrees to 2.5 degrees. The valve configuration process may record the data from the sensors indicative of water moving through the valve. The valve configuration process may iterate the valve position value the opposite direction by increasing the position value from 2.5 degrees to 3.5 degrees in response to recording an increase in the water movement past the flow control valve 152. The valve configuration process may record the periodic data from the sensors and evaluate the periodic data for indication of water movement after each iteration. If the valve configuration process does not detect water movement, the valve configuration process may write the valve position value as a measured valve position to a valve configuration file and end this portion of the configuration sequence. Said another way, the valve configuration process may record the measured valve position value and end this portion of the valve configuration process if the flow control valve 152 is holding pressure and isolating the return line 160 from water flow. If the valve does not hold pressure, the valve configuration process may determine the valve position value for the lowest amount of fluid flow past the valve to a valve configuration file, return an error value, and display an alert on the display 144. Although the valve position value is described in degrees, it is understood that the valve position value may use radians, a circumferential measurement, a polar coordinate system, or combination thereof. Although the valve position value is described in fraction of a degree, it is understood that the valve position value may be described in a portion of a degree, such as a fraction, e.g., %, or a decimal, e.g., 0.1. The valve configuration process may determine an error value by comparing the valve position value within the valve position dataset to the measured valve position value. The valve configuration process may write the error value to the valve configuration file and replace the valve position value within the valve position dataset with the measured valve position value within the valve configuration file.

The valve configuration process may adjust a plurality of valve position values of the flow control valve 152 in response to determining the valve positional value of the full open and full closed position value. Turning now to FIG. 4A, a pump performance graph 300 is illustrated. In an embodiment, a pump performance curve 310 may represent the flowrate of water through the liquid delivery system 134 with a plurality of combinations of the value of the pump speed of the supply pump 124 and the position values of the flow control valve 170. The pump performance curve 310 can include a y-axis 302 with flowrate units and an x-axis 304 with valve position units. For example, the y-axis 302 may represent the flowrate data with units of volumetric flowrate such as gallons per minute (GPM) or barrels per hour (BPH). The x-axis 304 may represent the valve position data as a percentage of the opening value of the valve position, such as 50% open or 100% open. The pump performance graph 300 may include a first curve 310, e.g., pump performance curve, for a value of the pump speed of the supply pump 124 of 100%. Although one pump performance curve is illustrated, it is understood that the graph may include a pump performance curve for 100%, 75%, 50% of pump speed. The valve positions may be displayed on the x-axis 304 of the pump performance graph 300. A first line 324 may represent a valve position of 93 degrees that corresponds to full open, e.g., 100% open. The minimum data point on the first curve 310 may be at the origin of the pump performance graph 300 where the valve position is closed, also referred to as 0% open. The pump performance curve 310 may have a plurality of valve positions, for example 0% open, 25% open, 50% open, 75% open, and 100% open. The valve configuration process may establish a valve positional value for a plurality of valve position values between 0% open and 100% open. The valve positional values may be determined by establishing an expected flow rate and adjusting the positional value of the valve by iterating the valve position while measuring the pressure and flowrate data. The valve positional values may be determined mathematically. For example, the valve positional value for full open, e.g., 100% and full closed, e.g., 0%, may be averaged to determine the valve position for 50% open.

In some embodiments, the valve configuration file may include identifying indicia, for example, a unique serial number, capable of uniquely identifying the unit controller 140, the pump unit 100, and/or one or more components of the pump unit 100.

In some embodiments, the valve configuration process may process the periodic dataset after the completion of the valve configuration process. The valve configuration process may produce a post-processing periodic dataset from the periodic dataset within the valve configuration file by applying one or more data reduction techniques to smooth the periodic set of data. The data reduction techniques may include data pre-processing, data cleansing, numerosity reduction, or a combination thereof. The data pre-processing technique may remove out-of-range values and flag missing values within the dataset. The data cleaning process may include the use of statistical methods, data duplicate elimination, and the parsing of data for the removal of corrupt or inaccurate data points. The post-processing periodic dataset may be saved to the valve configuration file set within the valve configuration file.

In some embodiments, the post-processing periodic dataset may be averaged to produce an averaged value representative for each set of periodic data. The average value may be a single value that represents a plurality of values across a given duration. The average value may be determined by applying one or more mathematical techniques such as an arithmetic mean, a median, a geometric median, a mode, a geometric mean, a harmonic mean, a generalized mean, a moving average, or combination thereof. The valve configuration process may save the average value dataset to the valve configuration file. In some embodiments, the average value may be determined as each of the plurality of periodic datasets is generated, for example, in real-time or, alternatively, at a later time.

In some embodiments, the assessing, post-processing, and averaging of the plurality of the periodic datasets may include one or more "Edge Computing" locations. For example, the unit controller 140 may transmit the system performance file to a network location via a mobile communication network for processing of the periodic datasets. The unit controller 140 may retrieve or receive the system performance file post-processing.

In an embodiment, the status of the flow control valve 152 can be determined based on the results of the valve configuration process. In some embodiments, the results of the valve configuration process may comprise one or more averaged values, a plurality of averaged values, valve position values, measured valve position values, or combination thereof. In an example, the results of the valve configuration process can be compared to the operational range of values for the mixing system 120. Additionally or alternatively, the results of the valve configuration process can be compared to maintained operational capacity, for example, an expected flowrate through the valve in the full open position and pressure capacity in the full closed position based upon prior use and maintenance of the mixing system. Additionally or alternatively, the results of the valve configuration process can be compared a historical database, for example, a flowrate for the full open and full closed position based upon historical data from multiple mixing systems and components.

In some embodiments, the valve configuration process may compare the valve configuration file to an operational range of values. The valve configuration process may alert the service personnel if one or more data points are outside of the operational range of values. For example, if the data point 325 for the maximum pump rate of the supply pump 124 is below a minimum operational value, the valve configuration process may alert the service personnel. In a second scenario, the valve configuration process may alert the service personnel if the sensors detect water passing the flow control valve 152 in the full closed position 320.

In some embodiments, the valve configuration process may compare the values within the valve configuration file to a database of failure modes. The failure modes of the operational indicator set can comprise one or more values indicative of one or more failure modes, e.g., isolation seal, of the flow control valve 152 of the mixing system 120 of the pump unit 100. The values of the failure modes, e.g., system data, can be indicative of one or more well-known failure modes of the mixing system 120 comprising the supply pump 124 and the flow control valve 152 of the liquid delivery system 134. For example, the seal on the flow control valve 152 not holding pressure in the closed position.

In an embodiment, the configuration check of the operational indicator set can comprise one or more values indicative of an operational capacity of the flow control valve 152. The operational capacity of the flow control valve can include the ability to deliver fluid at a desired or predetermined flowrate. The operational capacity of the flow control valve 152 can also include the ability to prevent or disconnect the fluidic communication through the flow control valve 152.

In an embodiment, the configuration check of the operational indicator set can comprise one or more values indicative of a proper configuration of the flow control valve 152.

The results from the comparison between the results of the valve configuration process and the operational indicator set may yield a status for the flow control valve 152 and/or the mixing system 120. For example, where the system performance file meets or exceeds the values of the configuration check, the mixing system may have a "passing" or "acceptable" status; where it does not, the mixing system may have a "failing" or unacceptable status. Additionally or alternatively, where the system performance file meets or exceeds the values of the operational capacity, check, the flow control valve 152 may have a "passing" or "acceptable" status; where it does not, the flow control valve 152 may have a "failing" or unacceptable status. Additionally or alternatively, where the valve configuration file meets or exceeds the values of the nominal operational capacity, check, the flow control valve 152 may have a "passing" or "acceptable" status; where it does not, the flow control valve may have a "failing" or unacceptable status. Additionally or alternatively, where the valve configuration file meets or exceeds the series of failure modes, the flow control valve 152 may have a "passing" or "acceptable" status; where it does not, the flow control valve may have a "failing" or unacceptable status.

In some embodiments, the comparison of the valve configuration file to an operational range of values or the database of failure modes may include one or more "Edge Computing" locations. For example, the unit controller 140 may transmit the valve configuration file to a network location via a mobile communication network for the comparison of the valve configuration file to the database of failure modes. The unit controller 140 may retrieve or receive the valve configuration file post-processing.

In some embodiments, the method for configuring the flow control valve 152 of the mixing system 120 may further comprise the step of creating one or more outputs responsive to the status of the flow control valve 152.

In various embodiments, the output may comprise indicia of the configuration of the flow control valve 152, for example, a visual cue (e.g., an indicator light), textual information or messages indicating the mixing system 120 status, an audible cue such as an alarm or a buzzer, or combinations thereof.

For example, referring to FIG. 2, the valve configuration process may display the alert on the interactive display 144. The alert may be displayed on the interactive display 144 as a curve, a table, or a simple pass or fail, e.g., pass/fail status. For example, a pass/fail status may include a color indicator including a green color for a passing status while a failing status can be a red color. A pass/fail status can include a multiple color indicator to indicate a range such as green, yellow, and red. For example, the yellow color can be a warning of a bottom of the range value. A pass/fail message, e.g., text message, may be included when the result is a fail.

Figure 5:
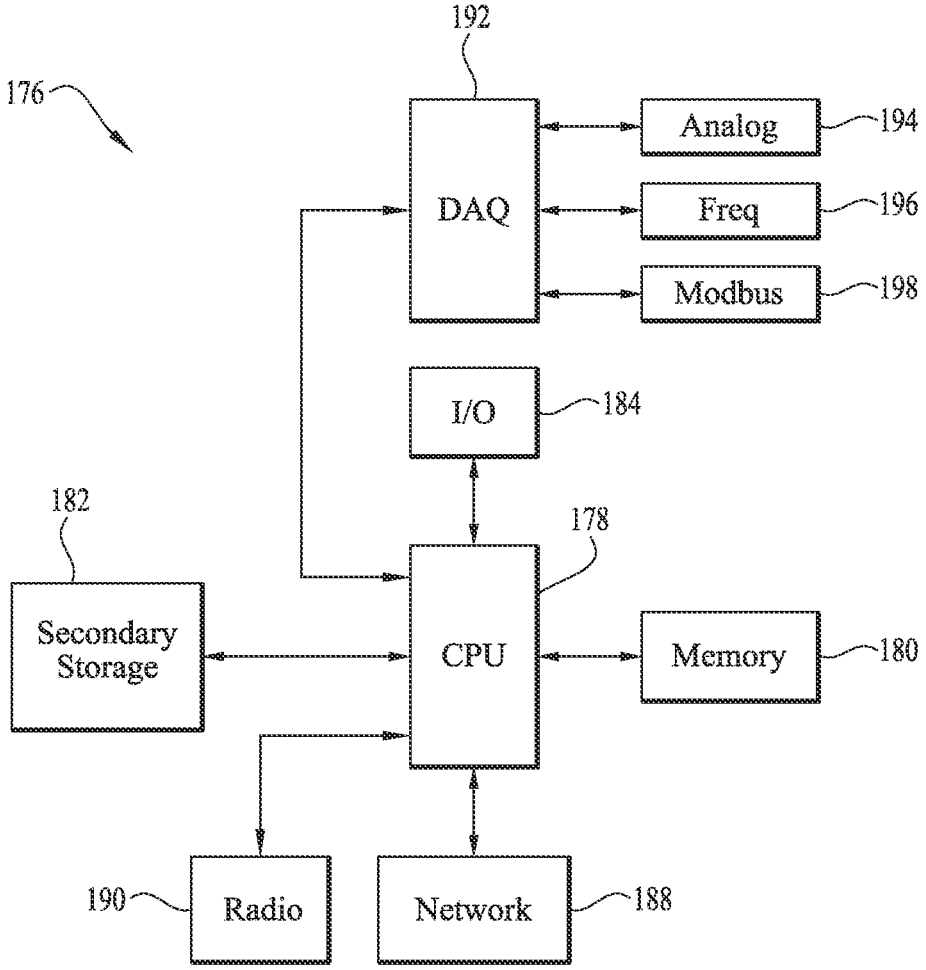
FIG. 5 is a block diagram of a unit controller according to an embodiment of the disclosure.

The unit control may be a computer system suitable for communication and control of the pumping unit. In FIG. 1, the unit controller 48 may establish control of the operation of the mixing equipment 44 and the pumping equipment 46 of the pump unit 34. In FIG. 2, the unit controller 140 may establish control of the operation of the mixing system 120 and the main pump 106 of the pump unit 100. In an embodiment, the unit controller 48 and/or 140 may be an exemplary computer system 176 described in FIG. 5. Turning now to FIG. 5, a computer system 176 suitable for implementing one or more embodiments of the unit controller, for example 48 and/or 140, including without limitation any aspect of the computing system associated with pump unit 34 of FIG. 1 and pump unit 100 of FIG. 2 and any aspect of a unit control as shown as unit controller 48 in FIG. 1 and unit controller 140 in FIG. 2. The computer system 176 includes one or more processors 178 (which may be referred to as a central processor unit or CPU) that is in communication with memory 180, secondary storage 182, input output devices 184, DAQ card 192, and network devices 188. The computer system 176 may continuously monitor the state of the input devices and change the state of the output devices based on a plurality of programmed instructions. The programming instructions may comprise one or more applications retrieved from memory 180 for executing by the processor 178 in non-transitory memory within memory 180. The input output devices may comprise a HMI, e.g., interactive display 144 in FIG. 2, with a display screen and the ability to receive conventional inputs from the service personnel such as push button, touch screen, keyboard, mouse, or any other such device or element that a service personnel may utilize to input a command to the computer system 176. The secondary storage 182 may comprise a solid state memory, a hard drive, or any other type of memory suitable for data storage. The secondary storage 182 may comprise removable memory storage devices such as solid state memory or removable memory media such as magnetic media and optical media, i.e., CD disks. The computer system 176 can communicate with various networks with the network devices 188 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 176 may include a long range radio transceiver 190 for communicating with mobile network providers as will be disclosed further herein.

The computer system 176 may comprise a DAQ card 192 for communication with one or more sensors. The DAQ card 192 may be a standalone system with a microprocessor, memory, and one or more applications executing in memory. The DAQ card 192, as illustrated, may be a card or a device within the computer system 176. In an embodiment, the DAQ card 192 may be combined with the input output device 184. The DAQ card 192 may receive one or more analog inputs 194, one or more frequency inputs 196, and one or more Modbus inputs 198. For example, the analog input 194 may include a tub level sensor. For example, the frequency input 196 may include a flow meter, i.e., 156 from FIG. 3. For example, the Modbus input 198 may include a pressure transducer, i.e., 164 from FIG. 3. The DAQ card 192 may convert the signals received via the analog input 194, the frequency input 196, and the Modbus input 198 into the corresponding sensor data. For example, the DAQ card 192 may convert a frequency input 196 from the flowrate sensor 156 shown in FIG. 3 into flow rate data measured in gallons per minute (GPM).

Data can be transmitted and received by various wired or wireless means between a service center and the pump unit 100 at a remote wellsite location for further processing. Turning now to FIG. 5, a data communication system 200 is described. The data communication system 200 comprises a wellsite 202 (where the pump unit 34 of FIG. 1 can be located), an access node 210 (e.g., cellular site), a mobile carrier network 254, a network 234, a storage computer 236, a service center 238, and a plurality of user devices 252. A wellsite 202 can include a pump unit 204 as part of a well construction operation pumping a service fluid into the wellhead 208 (e.g., 36 in FIG. 1). The pump unit 204 can include a communication device 206 (e.g., transceiver 190 of FIG. 5) that can transmit and receive via any suitable communication means (wired or wireless), for example, wirelessly connect to an access node 210 to transmit data (e.g., valve configuration file) to a storage computer 236. The storage computer 236 may also be referred to as a data server, data storage server, or remote server. The storage computer 236 may include a database of valve configuration files and valve configuration process results. Wireless communication can include various types of radio communication, including cellular, satellite 230, or any other form of long range radio communication. The communication device 206 can transmit data via wired connection for a portion or the entire way to the storage computer 236. The communication device 206 may communicate over a combination of wireless and wired communication. For example, communication device 206 may wirelessly connect to access node 210 that is communicatively connected to a network 234 via a mobile carrier network 254.

In an embodiment, the communication device 206 on the pump unit 204 is communicatively connected to the mobile carrier network 254 that comprises the access node 210, a 5G edge site 212, a 5G core network 220, and the network 234. The communication device 206 may be the transceiver 190 connected to the computer system 176 of FIG. 4. The computer system 176 may be the unit controller 140 of FIG. 2 or unit controller 48 of FIG. 1, thus the communication device 206 may be communicatively connected to the unit controller 140 and/or 48.

The access node 210 may also be referred to as a cellular site, cell tower, cell site, or, with 5G technology, a gigabit Node B. The access node 210 provides wireless communication links to the communication device 206, e.g., unit controller 140 and/or 48, according to a 5G, a long term evolution (LTE), a code division multiple access (CDMA), or a global system for mobile communications (GSM) wireless telecommunication protocol.

The communication device 206 may establish a wireless link with the mobile carrier network 254 (e.g., 5G core network 220) with a long-range radio transceiver, e.g., 190 of FIG. 4, to receive data, communications, and, in some cases, voice and/or video communications. The communication device 206 may also include a display and an input device (e.g., interactive display 144 or HMI), a camera (e.g., video, photograph, etc.), a speaker for audio, or a microphone for audio input by a user. The long-range radio transceiver, e.g., 190, of the communication device 206 may be able to establish wireless communication with the access node 210 based on a 5G, LTE, CDMA, or GSM telecommunications protocol. The communication device 206 may be able to support two or more different wireless telecommunication protocols and, accordingly, may be referred to in some contexts as a multi-protocol device. The communication device 206, e.g., 206A, may communicate with another communication device, e.g., 206B, on a second pump truck, e.g., 204B, via the wireless link provided by the access node 210 and via wired links provided by the mobile carrier network 254, e.g., 5G edge site 212 or the 5G core network 220. Although the pump unit 204 and the communication device 206 are illustrated as a single device, the pump unit 204 may be part of a system of pump units, e.g., a frac fleet. For example, a pump unit 204A may communicate with pump units 204B, 204C, 204D, 204E, and 204F at the same wellsite, e.g., 202 of FIG. 6, or at multiple wellsites. In an embodiment, the pump units 204A-E may be a different types of pump units at the same wellsite or at multiple wellsites. For example, the pump unit 204A may be a frac pump, pump unit 204B may be a blender, pump unit 204C may be water supply unit, pump unit 204D may be a cementing unit, and pump unit 204E may be a mud pump. The pump unit 204A-F may be communicatively coupled together at the same wellsite by one or more communication methods. The pump units 204A-F may be communicatively couple with a combination of wired and wireless communication methods. For example, a first group of pump units 204A-C may be communicatively coupled with wired communication, e.g., Ethernet. A second group of pump units 204D-E may be communicatively couple to the first group of pump units 204A-C with low powered wireless communication, e.g., WIFI. A third group of pump units 204F may be communicatively coupled to one or more of the first group or second group of pump units by a long range radio communication method, e.g., mobile communication network.

The 5G edge site 212 can be communicatively coupled to the access node 1210. The 5G edge site 212 may also be referred to as a regional data center (RDC) and can include a virtual network in the form of a cloud computing platform. The cloud computing platform can create a virtual network environment from standard hardware such as servers, switches, and storage. The total volume of computing availability 214 of the 5G edge site 212 is illustrated by a pie chart with a portion illustrated as a network slice 218 and the remaining computing availability 216. The network slice 218 represents the computing volume available for storage or for processing of data. The network slice 218 may be referred to as a network location. The cloud computing environment is described in more detail, further hereinafter. Although the 5G edge site 212 is shown communicatively coupled to the access node 210, it is understood that the 5G edge site 212 may be communicatively coupled to a plurality of access nodes (e.g., 210). The 5G edge site 212 may receive all or a portion of the voice and data communications from one or more access nodes (e.g., 210). The 5G edge site 212 may process all or a portion of the voice and data communications or may pass all or a portion to the 5G core network 220 as will be described further hereinafter. Although the virtual network is described as created from a cloud computing network, it is understood that the virtual network can be formed from a network function virtualization (NFV). The NFV can create a virtual network environment from standard hardware such as servers, switches, and storage. The NFV is more fully described by ETSI GS NFV 002 v1.2.1 (2014-12).

In some embodiments, a network location comprises a computational capacity communicatively coupled to a network. The network location can comprise a storage device, a computer system, a virtual computer environment, a virtual network function, or combination thereof communicatively connected to at least one network, e.g., 220. For example, a network location can be a user device such as user device 252 of FIG. 6, e.g., a computer system, communicatively connected to a network 234. In another example, a network location can be a storage computer 236 communicatively connected to a network 234. The computational capacity of the network location can be defined by the type of computer system utilized. For example, a VNF on a network slice 226 may have a greater computational capacity than a user device 252. In a context, the network location includes an application, a database, or combinations thereof. For example, a network location may include an application for post-processing data. In another scenario, a network location comprises one or more applications executing on a network slice 226 within a 5G Core Network 220. It is understood that a network location may be communicatively connected to via more than one network, such as network 234 and 5G core network 220.

The 5G core network 220 can be communicatively coupled to the 5G edge site 212 and provide a mobile communication network via the 5G edge site 212 and one or more access node 210. Although the access node 210 is illustrated as communicatively connected to the 5G edge site 212, it is understood that one or more access nodes, e.g., 210, may be communicatively connected to the 5G core network 220. The 5G core network 220 can include a virtual network in the form of a cloud computing platform. The cloud computing platform can create a virtual network environment from standard hardware such as servers, switches, and storage. The total volume of computing availability 222 of the 5G core network 220 is illustrated by a pie chart with a portion illustrated as a network slice 226 and the remaining computing availability 224. The network slice 226 may be referred to as a network location. The network slice 226 represents the computing volume available for storage or processing of data. The cloud computing environment is described in more detail further hereinafter. Although the 5G core network 220 is shown communicatively coupled to the 5G edge site 212, it is understood that the 5G core network 220 may be communicatively coupled to a plurality of access nodes (e.g., 210) in addition to one or more 5G edge sites (e.g., 212). The 5G core network 220 may be communicatively coupled to one or more Mini Data Centers (MDC). MDC may be generally described as a smaller version or self-contained 5G edge site comprising an access node, e.g., 210, with a cloud computing platform, e.g., a virtual network environment, created from standard computer system hardware, e.g., processors, switches, and storage. The 5G core network 220 may receive all or a portion of the voice and data communications via 5G edge site 212, one or more MDC nodes, and one or more access nodes (e.g., 122). The 5G core network 220 may process all or a portion of the voice and data communications as will be described further hereinafter. Although the virtual network is described as created from a cloud computing network, it is understood that the virtual network can be formed from a network function virtualization (NFV). The NFV can create a virtual network environment from standard hardware such as servers, switches, and storage.

A storage computer 236 can be communicatively coupled to the 5G network, e.g., mobile carrier network 254, via the network 234. The storage computer 236 can be a computer, a server, or any other type of storage device. The storage computer 236 may be referred to as a network location. The network 234 can be one or more public networks, one or more private networks, or a combination thereof. A portion of the Internet can be included in the network 234.

The valve configuration process may connect the long range radio transceiver 190 to a mobile carrier network 254 and transmit the valve configuration file, the valve position dataset, or combination thereof, to a remote service center 238, a central computer 240, a maintenance application 242, a user device 252, a storage computer 236, a network location, or combination thereof.

A service center 238 may be a base of operations and provide maintenance for the pump unit 204. The maintenance for the pump unit 204 can include repair, replacement, modification, upgrades, or a combination thereof of the equipment on the pump unit 204 including, referring back to FIG. 2, the unit controller 140, the DAQ card 142, the interactive display 144, i.e., HMI, the power supply 108, the supply tank 102, the mixing system 120, the additive system 122, the main pump 106, the plurality of pumps, e.g., 124, the plurality of valves, e.g., 170, the plurality of sensors, e.g., 156, or combinations thereof. For example, the service center 238 may provide maintenance for the supply pump 124 including repair, replacement, modification, or an upgrade. In a scenario, the service center 238 may replace one or more seals within the supply pump 124 based on a schedule or on a repair request.

The service center 238 may have a maintenance application 242 for the pump unit, e.g., 204, executing on a central computer 240. The maintenance application 242 may assign a pump unit, e.g., 204, for maintenance to one or more components on the pump unit, e.g., flow control valve 152, on the maintenance schedule 248. The assignment of the pump unit, e.g., 204, to the maintenance schedule 248 may be for repair, replacement, or modification of one or more components. In an embodiment, the maintenance application 242 may retrieve a valve configuration file from a historical database on the storage computer 236. The valve configuration file may include an alert that the valve configuration process generated a fault value, error value, or at least one data point below an operational threshold. For example, the valve configuration file may include an alert that the flowrate measured by the flowrate sensor, e.g., 156 in FIG. 3, is below a threshold value. The maintenance application 242 may alert one or more user devices 252 communicatively connected to the maintenance application 242 via the network 234.

In some embodiments, the valve configuration file may be transmitted from the communication device 206 of the pump unit 204 to the storage computer 236, to the maintenance application 242 executing on the central computer 240, or combination thereof, via the mobile carrier network 254. In an alternate embodiment, the maintenance application 242 may include a database of valve configuration files. In another embodiment, the central computer 240 may include a historical database of valve configuration files.

Although the maintenance application 242 is described as executing on a central computer 240, it is understood that the central computer 240 can be a computer system or any form of a computer system such as a server, a workstation, a desktop computer, a laptop computer, a tablet computer, a smartphone, or any other type of computing device. The central computer 240 (e.g., computer system) can include one or more processors, memory, input devices, and output devices, as described in more detail further hereinafter. Although the service center 238 is described as having the maintenance application 242 executing on a central computer 240, it is understood that the service center 238 can have 2, 3, 4, or any number of computers 240 (e.g., computer systems) with 2, 3, 4, or any number of maintenance applications 242 executing on the central computers 240.

Figure 6:
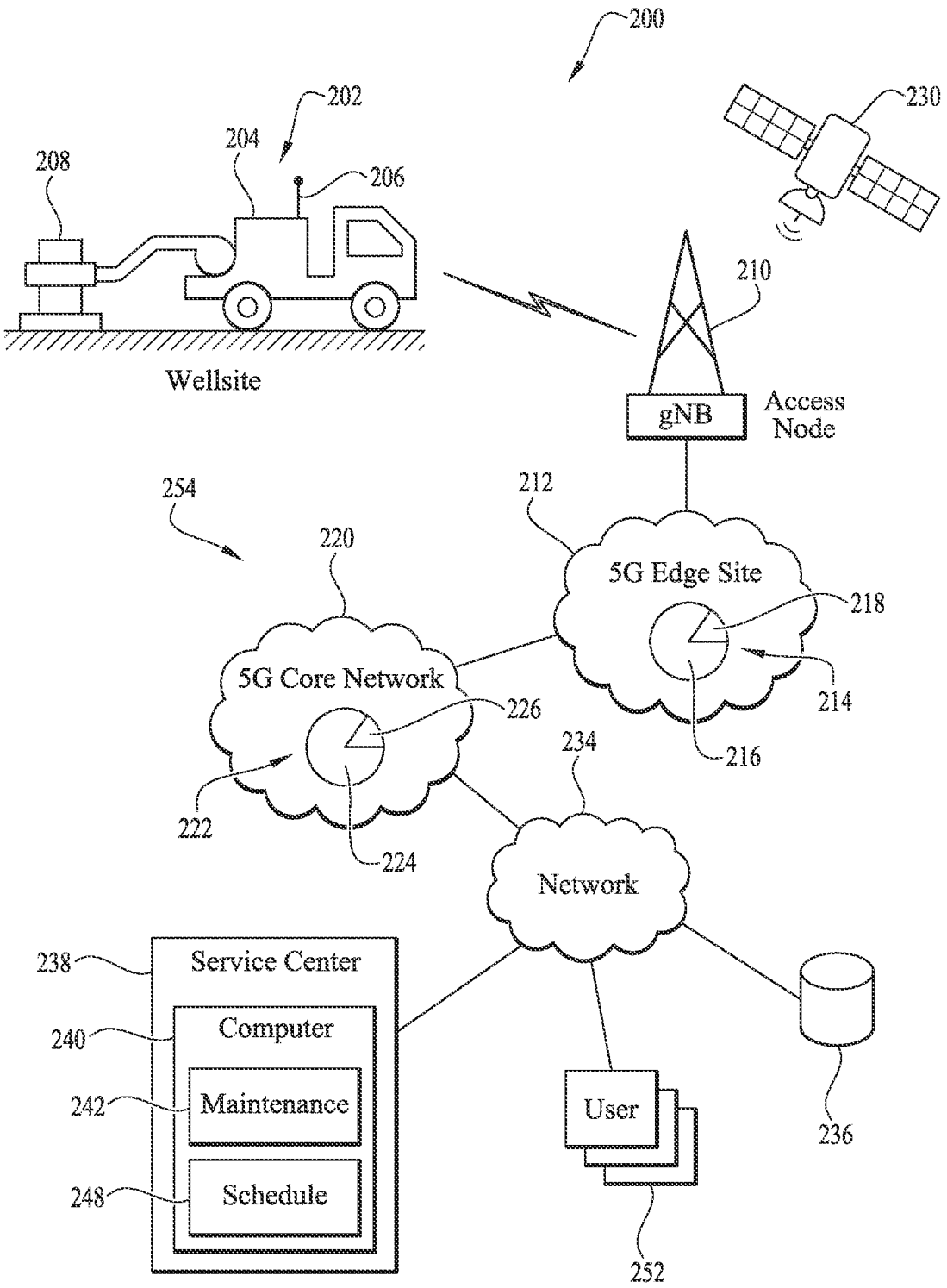
FIG. 6 is an illustration of a communication system according to an embodiment of the disclosure.
Figure 7:
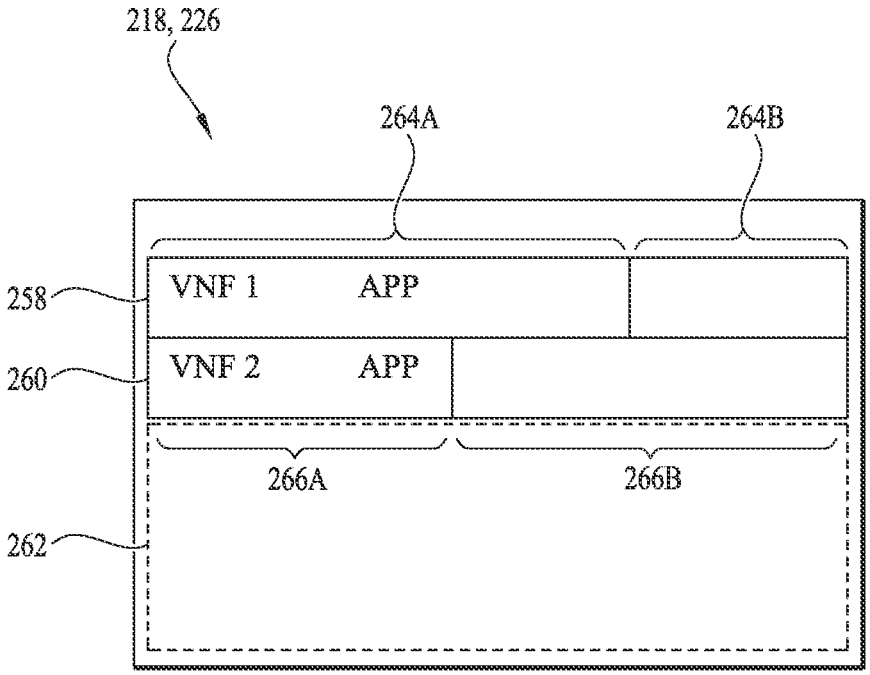
FIG. 7 is a block diagram of an application within a virtual network function on a network slice according to an embodiment of the disclosure.
Figure 9A:
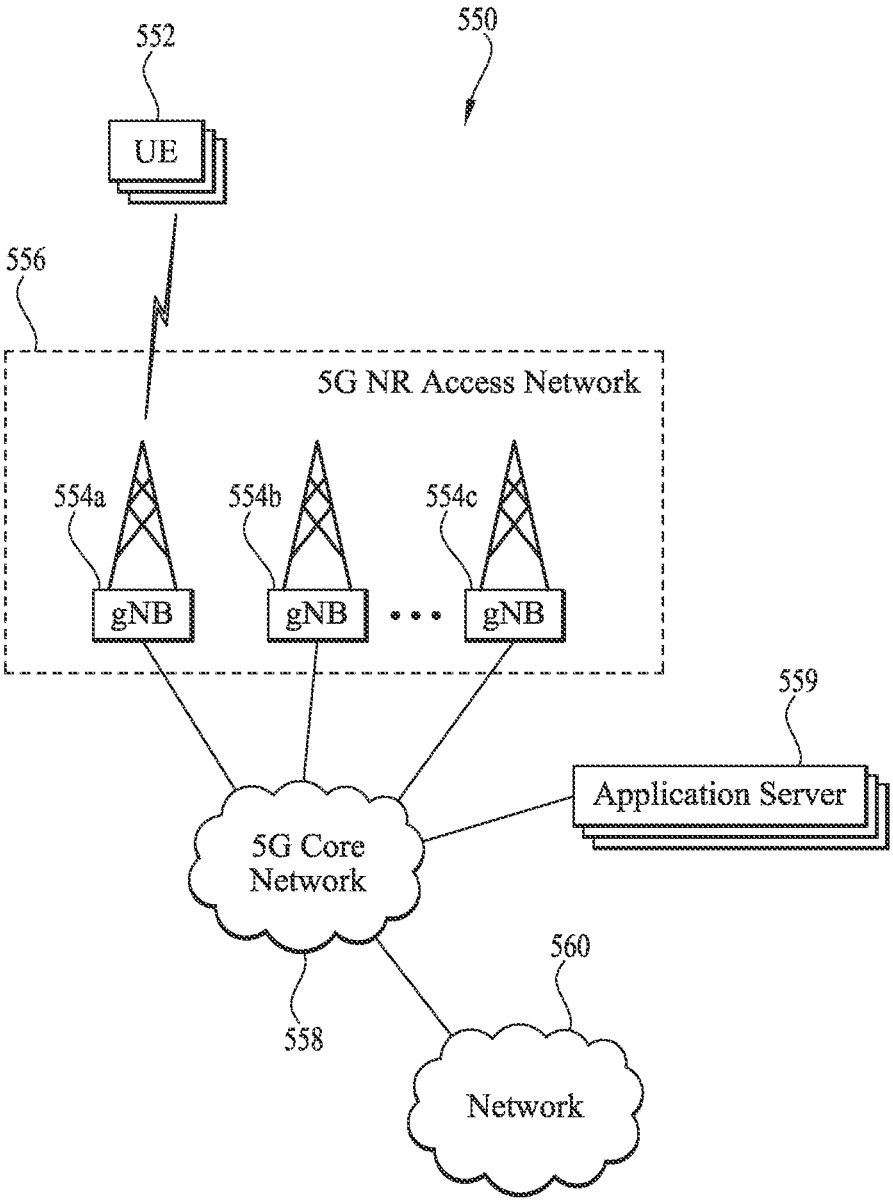

In an aspect, the mobile carrier network 254 includes a 5G core network 220 and a 5G edge site 212 with virtual servers in a cloud computing environment. One or more servers of the type disclosed herein, for example, storage computer 236 and central computer 240, can be provided by a virtual network function (VNF) executing within the 5G core network. The pump unit 204 on the wellsite 202 can be communicatively coupled to the 5G edge site 212, which includes the 5G core network 220 via the access node 210 (e.g., gigabit Node B) and thus can be communicatively coupled to one or more VNFs with virtual servers as will be more fully described hereinafter. Turning now to FIG. 6, a representative example of a network slice 218 and/or 226 is described. A computing service executing on network slice 218 and/or 226 can comprise a first virtual network function (VNF) 258, a second VNF 260, and an unallocated portion 262. The computing service can comprise a first application 264A executing on a first VNF 258 and a second application 266A executing on a second VNF 260. The first application 264A and second application 266A can be computing service applications generally referred to as remote applications. The total computing volume can comprise a first VNF 258, a second VNF 260, and an unallocated portion 262. The unallocated portion 262 can represent computing volume reserved for future use. The first VNF 258 can include a first application 264A and additionally allocated computing volume 264B. The second VNF 260 can include a second application 266A and additionally allocated computing volume 266B. Although two VNFs are illustrated, the network slice 218 and/or 226 can have a single VNF, two VNFs, or any number of VNFs. Although the first VNF 258 and second VNF 260 are illustrated with equal computing volumes, it is understood that the computing volumes can be non-equal and can vary depending on the computing volume needs of each application. The first application 264A executing in the first VNF 258 can be configured to communicate with or share data with the second application 266A executing in the second VNF 260. The first application 264A and second application 266A can be independent and not share data or communicate with each other. Although the network slice 218 and/or 226 is illustrated with two VNFs and an unallocated portion 262, the network slice 218 and/or 226 may be configured without an unallocated portion 262. Although only one application, a first application 264A, is described executing within the first VNF 258, two or more applications can be executing within the first VNF 258 and second VNF 260. In an embodiment, the network slice 218 and/or 226 may be the network slice 218 on the 5G edge site 212. In an embodiment, the network slice 226 may be the network slice 226 on the 5G core network 220. In an embodiment, the first application 264A and/or the second application 266A executing on the first VNF 258 and/or second VNF 260 may be the maintenance application 242, the maintenance schedule 248, the storage computer 236, the historical database of valve configuration files, or combination thereof.

In some embodiments, the unit controller 140 may establish a wireless communication session with a historical database on a network location. The unit controller 140 may compare the valve configuration file to at least one valve configuration file in the historical database. The unit controller 140 may alert the service personnel, a remote user device 252, the maintenance application 242, or combination thereof of a change in the valve configuration file greater than a threshold value. In some embodiments, the unit controller 140 may send a request of maintenance event to the maintenance application 242.

In some embodiments, a distributed computing system comprises the unit controller 140, at least one network location, or a combination thereof, communicatively connected. The distributed computing system can include two or more computer systems comprising a processor and non-transitory memory sharing a common goal and communicatively connected via a network, e.g., 5G Core Network 220. The common goal of the distributed computing system can include one or more processes that originate from a first computer system, also referred to as a managing computer system. The common goal of the distributed computing system may be distributed from the managing computer system to the network locations via messaging, for example filesharing, document sharing, email, text messaging, or combinations thereof. For example, the unit controller 140 may communicatively connect via mobile carrier network 254 and may transmit a periodic dataset for post-processing to one or more network locations, e.g., an application executing on the network slice 226. The network location can complete the post-processing and transmit the post-processing dataset to the unit controller 140. The unit controller 140 can be a managing computer system to distribute, share, or send/receive the processes to one or more network locations. In a context, the distributed computing system can comprise the unit controller 140 and two or more network locations. In a scenario, the unit controller 140 may communicatively connect and transmit two sets of periodic dataset for post processing to one each network locations, e.g., network slice 218 and remote computer 240. The network locations can each receive one or more periodic datasets and complete the post-processing and transmit the one or more post-processing datasets to the unit controller 140. In a context, the distributed computing system comprises the unit controller 140. In a second scenario where the unit controller 140 fails to communicatively connect to the network, e.g., 254, the unit controller 140 can complete the processing without a network location. In this scenario, the unit controller 140 can complete the processing of a shared process when the connection with a network location is lost. For example, if the unit controller 140 as no longer communicatively connected to a network location, the unit controller 140 can complete a process started by the network location.

Turning now to FIG. 8A, an exemplary communication system 550 is described suitable for implementing one or more embodiments disclosed herein, for example implementing communications or messaging as disclosed herein including without limitation any aspect of wireless communication between communication device 206 and mobile carrier network 254 on FIG. 5; any aspect of communications with the computing components and network associated with FIG. 4 (e.g., long range radio transceiver 190); etc. Typically, the communication system 550 includes a number of access nodes 554 that are configured to provide coverage in which UEs 552 such as cell phones, tablet computers, machine-type-communication devices, unit controllers, tracking devices, embedded wireless modules, and/or other wirelessly equipped communication devices (whether or not user operated), can operate. The access nodes 554 may be said to establish an access network 556. The access network 556 may be referred to as a radio access network (RAN) in some contexts. In a 5G technology generation an access node 554 may be referred to as a gigabit Node B (gNB). In 4G technology (e.g., long term evolution (LTE) technology) an access node 554 may be referred to as an enhanced Node B (eNB). In 3G technology (e.g., code division multiple access (CDMA) and global system for mobile communication (GSM)) an access node 554 may be referred to as a base transceiver station (BTS) combined with a basic station controller (BSC). In some contexts, the access node 554 may be referred to as a cell site or a cell tower. In some implementations, a picocell may provide some of the functionality of an access node 554, albeit with a constrained coverage area. Each of these different embodiments of an access node 554 may be considered to provide roughly similar functions in the different technology generations.

In an embodiment, the access network 556 comprises a first access node 554*a*, a second access node 554*b*, and a third access node 554*c*. It is understood that the access network 556 may include any number of access nodes 554. Further, each access node 554 could be coupled with a core network 558 that provides connectivity with various application servers 559 and/or a network 560. In an embodiment, at least some of the application servers 559 may be located close to the network edge (e.g., geographically close to the UE 552 and the end user) to deliver so-called "edge computing." The network 560 may be one or more private networks, one or more public networks, or a combination thereof. The network 560 may comprise the public switched telephone network (PSTN). The network 560 may comprise the Internet. With this arrangement, a UE 552 within coverage of the access network 556 could engage in air-interface communication with an access node 554 and could thereby communicate via the access node 554 with various application servers and other entities.

The communication system 550 could operate in accordance with a particular radio access technology (RAT), with communications from an access node 554 to UEs 552 defining a downlink or forward link and communications from the UEs 552 to the access node 554 defining an uplink or reverse link. Over the years, the industry has developed various generations of RATs, in a continuous effort to increase available data rate and quality of service for end users. These generations have ranged from "1G," which used simple analog frequency modulation to facilitate basic voice-call service, to "4G"—such as Long Term Evolution (LTE), which now facilitates mobile broadband service using technologies such as orthogonal frequency division multiplexing (OFDM) and multiple input multiple output (MIMO).

Figure 8B:
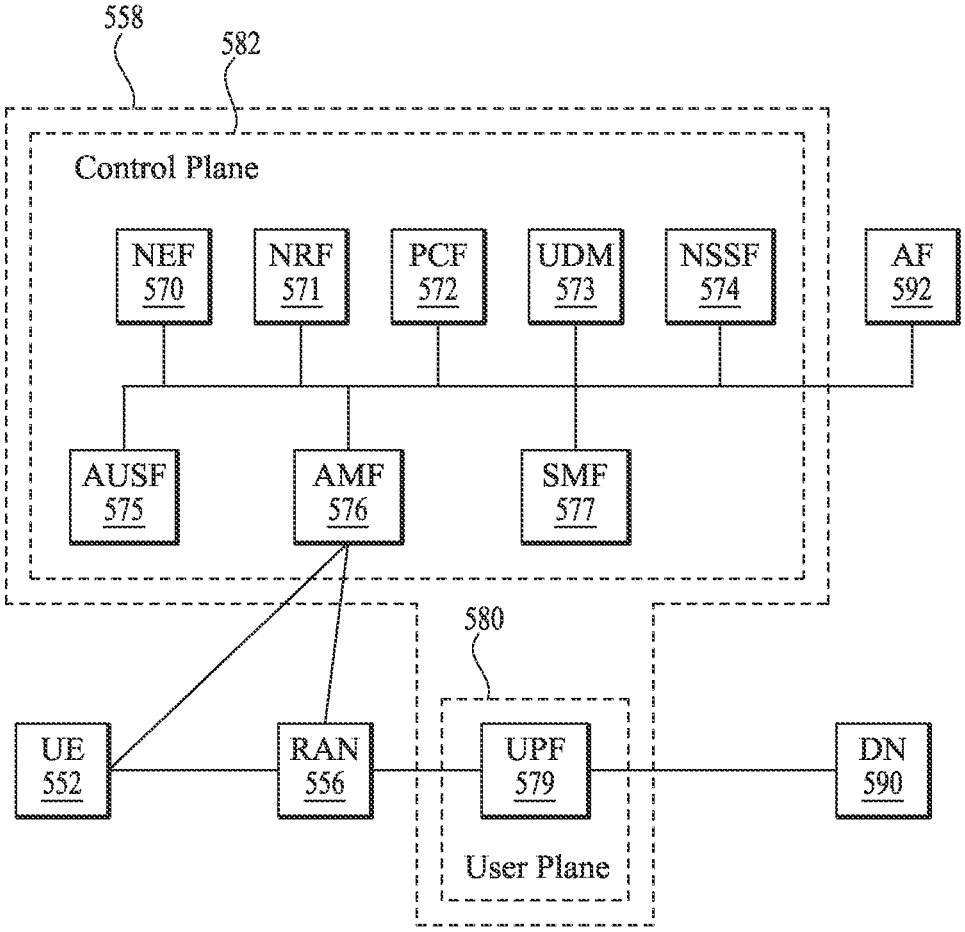
FIG. 8B is a block diagram of a 5G core network according to an embodiment of the disclosure.

Turning now to FIG. 8B, further details of the core network 558 are described. In an embodiment, the core network 558 is a 5G core network. 5G core network technology is based on a service based architecture paradigm. Rather than constructing the 5G core network as a series of special purpose communication nodes (e.g., an HSS node, a MME node, etc.) running on dedicated server computers, the 5G core network is provided as a set of services or network functions. These services or network functions can be executed on virtual servers in a cloud computing environment which supports dynamic scaling and avoidance of long-term capital expenditures (fees for use may substitute for capital expenditures). These network functions can include, for example, a user plane function (UPF) 579, an authentication server function (AUSF) 575, an access and mobility management function (AMF) 576, a session management function (SMF) 577, a network exposure function (NEF) 570, a network repository function (NRF) 571, a policy control function (PCF) 572, a unified data management (UDM) 573, a network slice selection function (NSSF) 574, and other network functions. The network functions may be referred to as virtual network functions (VNFs) in some contexts.

Network functions may be formed by a combination of small pieces of software called microservices. Some microservices can be re-used in composing different network functions, thereby leveraging the utility of such microservices. Network functions may offer services to other network functions by extending application programming interfaces (APIs) to those other network functions that call their services via the APIs. The 5G core network 558 may be segregated into a user plane 580 and a control plane 582, thereby promoting independent scalability, evolution, and flexible deployment.

The NEF 570 securely exposes the services and capabilities provided by network functions. The NRF 571 supports service registration by network functions and discovery of network functions by other network functions. The PCF 572 supports policy control decisions and flow based charging control. The UDM 573 manages network user data and can be paired with a user data repository (UDR) that stores user data such as customer profile information, customer authentication number, and encryption keys for the information. An application function 592, which may be located outside of the core network 558, exposes the application layer for interacting with the core network 558. In an embodiment, the application function 592 may be execute on an application server 559 located geographically proximate to the UE 552 in an "edge computing" deployment mode. The core network 558 can provide a network slice to a subscriber, for example an enterprise customer, that is composed of a plurality of 5G network functions that are configured to provide customized communication service for that subscriber, for example to provide communication service in accordance with communication policies defined by the customer. The NSSF 574 can help the AMF 576 to select the network slice instance (NSI) for use with the UE 552.

The systems and methods disclosed herein may be advantageously employed in the context of wellbore servicing operations, particularly, in relation to the usage of wellbore servicing equipment as disclosed herein.

In an embodiment, the valve configuration process disclosed herein may identify equipment failures or decreases in operability that might not otherwise be identifiable. For example, a failure to seal when a valve is in the full closed position (e.g., the flow control valve 152) may be gradual and difficult to quantify or identify. The valve configuration process disclosed herein, in which a series of test positions of the flow control valve 152 can determine the proper alignment of the positional values of the flow control valve 152. The valve configuration application can replace errant positional values and thus improve the operation of the liquid delivery system 134.

Additionally or alternatively, the valve configuration process disclosed herein may be automatically performed prior to the initiation of a wellbore servicing operation, at the completion of a wellbore servicing operation, or both. The unit controller 140 may automatically initiate a diagnostic test upon startup or shutdown of the pump unit 100, or may prompt the service personnel to initiate the valve configuration process. The unit controller 140 may prevent operation of the pump unit 100 until the valve configuration process is completed.

Additionally or alternatively, the valve configuration process can determine if one or more components of the mixing system 120 has decreased in operational capacity below a threshold value.

Additional Disclosure—Part A

The following are non-limiting, specific embodiments in accordance with the present disclosure:

A first embodiment, which is a computer-implemented method of performing an automated configuration of a mixing system on a wellbore pump unit, comprising configuring, by a unit controller, a flow loop on the wellbore pump unit, wherein the flow loop comprises a supply pump, a flow control valve, a flow rate sensor, and a volume of water, and wherein the unit controller comprises a processor, a non-transitory memory, and an input output device; measuring, by a unit controller, a flowrate of the flow loop by opening the flow control valve to a first position value from a valve position dataset, operating the supply pump at a pump speed value, and recording a periodic dataset to memory, wherein the periodic dataset comprises a pump speed value, a measured valve position, a flowrate, at least one pressure sensor, or combination thereof; determining, by a distributed computing system, an error value for the valve position dataset by comparing the measured valve position to the valve position dataset; adjusting, by the distributed computing system, the valve position dataset from a first value to a second value, wherein the second value includes the measured valve position value; determining, by the distributed computing system, a pass/fail status in response to a comparison of the valve position dataset to an operational indicator set; and displaying, by the unit controller, the pass/fail status via the input output device; wherein the input output device comprises an interactive display, and wherein the pass/fail status comprises a color indicator, a text message, or combination thereof.

A second embodiment, which is the method of the first embodiment, wherein the valve position dataset comprises a first value for a closed valve position value, a second value for the open valve position value, the error value, or combination thereof.

A third embodiment, which is the method of the first embodiment, wherein the operational indicator set comprises a series of failure modes, an operational capacity, a proper configuration, or combination thereof.

A fourth embodiment, which is the method of the first embodiment, further comprising modifying, by the unit controller, a position value of the flow control valve for each combination of valve position value of a series of position values; and writing, by the unit controller, to memory the measured valve position value for each combination of valve position value of the series of position values.

A fifth embodiment, which is the method of the first embodiment, wherein the series of position values of the flow control valve comprise incrementing the value of the valve position in a first direction in response to the flowrate or pressure increasing and incrementing the value of the valve position in a second direction in response to the flowrate or pressure decreasing; wherein the unit controller, in response to the valve position value being in an open position, begins in the first direction and changes to the second direction; and wherein the unit controller, in response to the valve position value being in a closed position, begins in a second direction and changes to a first direction.

A sixth embodiment, which is the method of the first embodiment, wherein the speed values of the supply pump comprise 25%, 50%, 75%, 100%, or combinations thereof.

A seventh embodiment, which is the method the first embodiment, further comprising generating, by the distributed computing system, a post-processing periodic dataset by applying one or more data reduction techniques to the periodic dataset, wherein the data reduction techniques include data pre-processing, data cleansing, numerosity reduction, or a combination thereof; generating, by the distributed computing system, an averaged value for each set of the post-processing periodic dataset by averaging the post-processing periodic dataset with a mathematical averaging technique, wherein the mathematical averaging techniques includes arithmetic mean, a median, a geometric median, a mode, a geometric mean, a harmonic mean, a generalized mean, a moving average, or combination thereof; and writing, by the distributed computing system, to memory the averaged value of the post-processing periodic dataset.

An eighth embodiment, which is the method of any of the first through the seventh embodiments, further comprising writing, by the unit controller, to the valve position dataset an indicia identifying the unit controller.

A ninth embodiment, which is the method of the first embodiment, further comprising transporting a wellbore treatment blend and the wellbore pumping unit to a wellsite, wherein the wellbore treatment blend is specified in a pumping procedure; connecting the wellbore pumping unit to a wellhead, wherein the wellbore pumping unit is fluidically connected to a wellbore; starting up the unit controller on the pumping unit; initiating a valve configuration application in response to a start-up procedure, an alert from a diagnostic test, a file status, a time status, a remote alert, or combination thereof, wherein the valve configuration application executes on the unit controller; and pumping the wellbore treatment into the wellbore per the pumping procedure in response to the unit controller generating a pass status.

A tenth embodiment, which is the method of the ninth embodiments, wherein the file status of a valve configuration file comprises a missing file, a corrupted file, or combination thereof.

An eleventh embodiment, which is the method of the ninth embodiments, further wherein the time status comprises a time value exceeding a threshold value, wherein the time value comprises years, months, weeks, days, hours, minutes, seconds, or combinations thereof.

A twelfth embodiment, which is the method of the ninth embodiments, wherein the remote alert comprises an alert from a service center in response to a fail status in a received valve configuration file, a comparison value from a database in a network location, a predetermined schedule, or combination thereof.

A thirteenth embodiment, which is the method of the first embodiment, wherein: the distributed computing system comprises the unit controller, at least one network location, or combinations thereof communicatively connected via a network, a mobile network, or combination thereof; wherein the distributed computing system communicatively connects to the mobile network via a wireless communication protocol; and wherein the wireless communication protocol communicates wirelessly according to at least one of a 5G, a long term evolution (LTE), a code division multiple access (CDMA), or a global system for mobile communications (GSM) telecommunications protocol.

A fourteenth embodiment, which is a method of the thirteenth embodiment, wherein: the network location is one of i) a virtual network function (VNF) on a network slice within a 5G core network, ii) a VNF on a network slice within a 5G edge network, iii) a storage computer communicatively coupled via a mobile communication network, or iv) a computer system communicatively coupled via the mobile communication network.

A fifteenth embodiment, which is the method of the fourteenth embodiment, wherein: the network location comprises a remote application, a database, a storage device, a computer system, a VNF, or combination thereof.

A sixteenth embodiment, which is a method of requesting a maintenance event by a distributed computing system on a wellbore pump unit, comprising configuring, by a unit controller, a flow loop comprising a supply pump, a flow control valve, a flowrate sensor, and a volume of water, and wherein the unit controller comprises a processor, a non-transitory memory, and an input output device; generating, by the unit controller, a measured dataset in the memory of the unit controller comprising a plurality of valve positional values and flowrates while operating the supply pump and adjusting the position of the flow control valve with a series of position values; writing, by the distributed computing system, to the measured dataset a pass/fail status of the measured dataset in response to a comparison of the measured dataset to an operational range, a failure mode, or combination thereof, wherein a fail status is assigned to the measured dataset in response to at least one measured dataset exceeding an operational range, returning a failure mode, or combination thereof; displaying, by the unit controller, a passing or a failing status of the measured datasets via a display; and alerting, by the distributed computing system, a maintenance application located in a network location the passing or the failing status of the measured datasets via a wireless communication protocol.

A seventeenth embodiment, which is the method of the sixteenth embodiment, further comprising accessing, by the distributed computing system, a historical database on a network location; comparing, by the distributed computing system, the measured dataset to at least one historical valve configuration file; alerting, by the distributed computing system, a service center of a change in a sensor value from a comparison of the measured dataset to the at least one historical valve configuration file is greater than a threshold value, wherein the sensor value is an operational pump capacity value, a flow valve position value, flowrate sensor value, or a combination thereof; and requesting, by the distributed computing system, maintenance on the supply pump, flow control valve, flowrate sensor, or a combination thereof in response to the change in the valve configuration file.

An eighteenth embodiment, which is a system of wellbore pumping unit, comprising a wellbore pumping unit comprising a mixing system comprising a supply pump, a flow control valve, and a flowrate sensor, a plurality of fluid sensors, or combination thereof, wherein the plurality of fluid sensors comprise one or more pressure sensors, flowrate sensors, valve position sensors, or combinations thereof; a distributed computing system comprising a unit controller, a network location, or combination thereof, wherein the unit controller comprises a processor, a non-transitory memory, a display, a valve configuration file, and a valve configuration process executing in memory, configured to: generating, by the distributed computing system, a measured data set via a valve configuration process; alerting, by the distributed computing system, a service personnel of a pass/fail status of a valve configuration of the flow control valve; wherein the pass/fail status of the valve configuration is in response to a comparison, by the distributed computing system, of a measured position dataset to an operational indicator set, a file status, a time limit, a remote flag, or a combination thereof, and wherein the valve configuration process is performed on a flow loop; wherein the flow loop, configured by the distributed computing system, comprises the supply pump, the control valve, the fluid sensors, and a volume of water; wherein the valve configuration process comprises a series of combinations of a pump speed value and a plurality of positional values of the flow control valve, by the distributed computing system, to pump water through the flow loop and measure, by the fluid sensors, a measured dataset, and wherein the measured dataset is saved to memory; wherein a pass status is assigned, by the distributed computing system, in response to adjusting the position value of a valve position dataset to a measured valve position value; wherein a fail status is assigned in response to the values of the valve position dataset indicating at least one failure modes of the operational indicator set; and wherein the alert generated by the unit controller comprises the pass/fail status via a display.

A nineteenth embodiment, which is the system of the eighteenth embodiment, wherein the plurality of positional values of the flow control valve comprise an iterative sequence up to and past a full open position of the flow control valve, wherein the full open position is 100% open.

A twentieth embodiment, which is the system of the nineteenth embodiments, wherein the plurality of positional values of the flow control valve comprise an iterative sequence up to and past a closed position of the flow control valve, wherein the closed position is 0% open.

Additional Disclosure—Part B

The following are non-limiting, specific embodiments in accordance with the present disclosure:

A first embodiment, which is a computer-implemented method of automatically configuring a mixing system associated with a wellbore pump unit, the method comprising establishing, by a unit controller, a flow loop providing a route of fluid communication via a supply pump, a flow control valve, and a flow rate sensor, wherein the unit controller comprises a processor, a non-transitory memory, and an input output device, performing, by the unit controller, a valve configuration process, wherein the valve configuration process comprises positioning the flow control valve in a first position, operating the supply pump to communicate a fluid via the flow loop at a first speed, measuring, by the flow sensor, a first periodic dataset while the fluid is communicated via the flow loop with the flow control valve in the first position, and recording the first periodic dataset in memory, wherein the first periodic dataset is associated with the first speed of the supply pump and the first position of the flow control valve, comparing a result of the valve configuration process to an operational indicator set, determining an error value in a valve position dataset that comprises a relationship between an angular position of a valve stem of the flow control valve and a position of the flow control valve based upon a comparison of the result of the valve configuration process and the operational indicator set, and configuring a flow control valve by adjusting the valve position dataset in response to an error value.

A second embodiment, which is the method of the first embodiment, wherein the valve position dataset comprises a first valve position value for a closed valve position value, a second valve position value for an open valve position value, the error value, or combination thereof.

A third embodiment, which is the method of any of the first and the second embodiments, further comprising outputting, by the unit controller, indicia of the valve configuration of the flow control valve via the input output device, wherein the indicia of the configuration of the flow control valve comprises a visual cue, and audible cue, or both.

A fourth embodiment, which is the method of any of the first through the third embodiments, wherein the valve configuration process further comprises operating the supply pump to communicate the fluid via the flow loop at the first speed, incrementing the value of the valve position in a first direction in response to a flowrate or a pressure increasing or incrementing the value of the valve position in a second direction in response to the flowrate or the pressure decreasing, measuring, by the flow sensor, an incremental periodic dataset while the fluid is communicated via the flow loop with the flow control valve in the incremental position, and recording the incremental periodic dataset in memory, wherein the incremental periodic dataset is associated with the first speed of the supply pump and the incremental position of the flow control valve.

A fifth embodiment, which is the method of the fourth embodiment, wherein the unit controller, in response to the valve position value being in an open position, begins in the first direction and changes to the second direction, and wherein the unit controller, in response to the valve position value being in a closed position, begins in the second direction and changes to the first direction.

A sixth embodiment, which is the method of any of the first through the fifth embodiments, wherein the operational indicator set comprises a configuration check, a minimum operational capacity, a nominal operational capacity, and a series of failure modes.

A seventh embodiment, which is the method of any of the first through the sixth embodiments, further comprising generating a post-processing periodic dataset by applying one or more data reduction techniques to the first periodic dataset, wherein the data reduction techniques include data pre-processing, data cleansing, numerosity reduction, or a combination thereof, generating a first averaged value for the post-processing periodic dataset by averaging the post-processing periodic dataset with a mathematical averaging technique, wherein the mathematical averaging techniques includes arithmetic mean, a median, a geometric median, a mode, a geometric mean, a harmonic mean, a generalized mean, a moving average, or combination thereof, generating a first measured valve position value for a closed position in response to one of the values of the dataset comprising a minimum value, generating a second measured valve position value for an open position in response to one of the values of the dataset comprising a maximum value, generating a first error value for the closed position by comparing the first measured valve position value to the valve position dataset, and generating a second error value for the open position by comparing the second measured valve position value to the valve position dataset.

An eighth embodiment, which is the method of the seventh embodiment, wherein the result of the valve configuration process to which the operational indicator set is compared comprises the post-processing periodic dataset, the averaged value, the first measured valve position, the second measured valve position, the first error value, the second error value, or combination thereof.

A ninth embodiment, which is the method of the eighth embodiment, wherein one or more of comparing the result of the valve configuration process to the operational indicator set, determining the pass/fail status of the valve configuration process based upon the comparison of the result of the valve configuration process and the operational indicator set, generating the incremental post-processing periodic dataset, generating the incremental averaged value for the incremental post-processing periodic dataset, generating the first measured valve position value and the second measure valve position, generating the generating a first error value for the closed position and the second error value for the open position is performed via the unit controller.

A tenth embodiment, which is the method of any of the eighth and the ninth embodiments, wherein one or more of comparing the result of the valve configuration process to the operational indicator set, determining the pass/fail status of the valve configuration process based upon the comparison of the result of the valve configuration process and the operational indicator set, generating the incremental post-processing periodic dataset, generating the incremental averaged value for the incremental post-processing periodic dataset, generating the first measured valve position value and the second measure valve position, generating the generating a first error value for the closed position and the second error value for the open position is performed via a network location.

An eleventh embodiment, which is the method of the tenth embodiment, further comprising transmitting the first periodic dataset, the first post-processing periodic dataset, the first averaged value for the first post-processing periodic dataset, or combinations thereof to the network location via a wireless communication protocol.

A twelfth embodiment, which is the method of the eleventh embodiment, wherein the wireless communication protocol is at least one of a 5G, a long-term evolution (LTE), a code division multiple access (CDMA), or a global system for mobile communications (GSM) telecommunications protocol.

A thirteenth embodiment, which is the method of any of the tenth through the twelfth embodiments, wherein the network location is one of i) a virtual network function (VNF) on a network slice within a 5G core network, ii) a VNF on a network slice within a 5G edge network, iii) a storage computer communicatively coupled to a network via a mobile communication network, or iv) a computer system communicatively coupled to the network via the mobile communication network.

A fourteenth embodiment, which is the method of the thirteenth embodiment, wherein the network location comprises a database, a storage device, a remote computer system, a virtual computer system, a virtual network function, or combination thereof.

A fifteenth embodiment, which is the method of any of the thirteenth and the fourteenth embodiments, further comprising accessing, by a process executing on the network location, a historical database on the network location, the historical database comprising data associated with a plurality of pump units.

A sixteenth embodiment, which is a wellbore servicing method comprising transporting a pump unit to a wellsite, the pump unit comprising unit controller configured to perform a valve configuration process, wherein the unit controller comprises a processor, a non-transitory memory, and an input output device fluidically connecting the pump unit to a wellhead, establishing a flow loop providing a route of fluid communication via a supply pump, a flow control valve, and a flow rate sensor, performing the valve configuration process, wherein the valve configuration process comprises positioning the flow control valve in a first position, operating the supply pump to communicate a fluid via the flow loop at a first speed, measuring, by the flow sensor, a first periodic dataset while the fluid is communicated via the flow loop with the flow control valve in the first position, and recording the first periodic dataset in memory, wherein the first periodic dataset is associated with the first speed of the supply pump and the first position of the flow control valve, comparing a result of the valve configuration process to an operational indicator set, configuring a flow control valve with the result of the valve configuration process by adjusting a valve position dataset from a first value to a second value in response to an error value, wherein the second value includes a measured valve position value, determining a pass/fail status of one or more components of the pump unit based upon a comparison of the result of the valve configuration process and the operational indicator set, and where the pass/fail status of the one or more components of the pump unit is a passing status, pumping a wellbore treatment into the wellbore.

A seventeenth embodiment, which is a system of wellbore pumping unit, comprising a wellbore pumping unit comprising a mixing system comprising a supply pump, a flow control valve, and a plurality of sensors, a unit controller comprising a processor, a non-transitory memory, an interactive display, a system performance file, and a valve configuration process executing in memory, configured to establish a flow loop providing a route of fluid communication via the supply pump, the flow control valve, and a flow rate sensor, wherein the unit controller comprises a processor, a non-transitory memory, and an input output device, perform a valve configuration process, wherein the valve configuration process comprises positioning the flow control valve in a first position, operating the supply pump to communicate a fluid via the flow loop at a first speed, measuring, by the flow sensor, a first periodic dataset while the fluid is communicated via the flow loop with the flow control valve in the first position, and recording the first periodic dataset in memory, wherein the first periodic dataset is associated with the first speed of the supply pump and the first position of the flow control valve, generate an error value for the first valve position by comparing a result to a valve position dataset, adjust the valve position dataset from a first value to a second value, wherein the second value includes the result, compare the result of the valve configuration process to an operational indicator set, determine a pass/fail status of the mixing system based upon the comparison of the result of the valve configuration process and the operational indicator set, and output indicia of the pass/fail status of the mixing system via the input output device, wherein the pass/fail status of the mixing system a visual cue, and audible cue, or both.

An eighteenth embodiment, which is the system of the seventeenth embodiment, wherein the sensors comprise a plurality of pressure sensors, a flowrate sensor, one or more valve position sensors, a tub level sensor, or combinations thereof.

A nineteenth embodiment, which is the system of any of the seventeenth and the eighteenth embodiments, further comprising a remote computer in communication with the unit controller via a wireless communication protocol.

A twentieth embodiment, which is the system of the nineteenth embodiment, wherein the wireless communication protocol is at least one of a 5G, a long-term evolution (LTE), a code division multiple access (CDMA), or a global system for mobile communications (GSM) telecommunications protocol.

A twenty-first embodiment, which is the system of any of the seventeenth through the twentieth embodiments, wherein the wellbore pumping unit is a mud pump, a cement pumping unit, a blender unit, a water supply unit, or a fracturing pump.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A computer-implemented method of automatically configuring a mixing system associated with a wellbore pump unit, the method comprising:

establishing, by a unit controller, a flow loop providing a route of fluid communication via a supply pump, a flow control valve, and a flow rate sensor, wherein the unit controller comprises a processor, a non-transitory memory, and an input output device;

performing, by the unit controller, a valve configuration process, wherein the valve configuration process comprises:

positioning the flow control valve in a first position;

operating the supply pump to communicate a fluid via the flow loop at a first speed;

measuring, by the flow sensor, a first periodic dataset while the fluid is communicated via the flow loop with the flow control valve in the first position; and recording the first periodic dataset in memory, wherein the first periodic dataset is associated with the first speed of the supply pump and the first position of the flow control valve;

comparing a result of the valve configuration process to an operational indicator set;

determining an error value in a valve position dataset that comprises a relationship between an angular position of a valve stem of the flow control valve and a position of the flow control valve based upon a comparison of the result of the valve configuration process and the operational indicator set; and configuring a flow control valve by adjusting the valve position dataset in response to an error value.

2. The method of claim 1, wherein the valve position dataset comprises a first valve position value for a closed valve position value, a second valve position value for an open valve position value, the error value, or combination thereof.

3. The method of claim 1, further comprising outputting, by the unit controller, indicia of the valve configuration of the flow control valve via the input output device, wherein the indicia of the configuration of the flow control valve comprises a visual cue, and audible cue, or both.

4. The method of claim 1, wherein the valve configuration process further comprises:

operating the supply pump to communicate the fluid via the flow loop at the first speed;

incrementing the value of the valve position in a first direction in response to a flowrate or a pressure increasing or incrementing the value of the valve position in a second direction in response to the flowrate or the pressure decreasing;

measuring, by the flow sensor, an incremental periodic dataset while the fluid is communicated via the flow loop with the flow control valve in the incremental position; and recording the incremental periodic dataset in memory, wherein the incremental periodic dataset is associated with the first speed of the supply pump and the incremental position of the flow control valve.

5. The method of claim 4, wherein the unit controller, in response to the valve position value being in an open position, begins in the first direction and changes to the second direction; and wherein the unit controller, in response to the valve position value being in a closed position, begins in the second direction and changes to the first direction.

6. The method of claim 1, wherein the operational indicator set comprises a configuration check, a minimum operational capacity, a nominal operational capacity, and a series of failure modes.

7. The method of claim 1, further comprising:

generating a post-processing periodic dataset by applying one or more data reduction techniques to the first periodic dataset, wherein the data reduction techniques include data pre-processing, data cleansing, numerosity reduction, or a combination thereof;

generating a first averaged value for the post-processing periodic dataset by averaging the post-processing periodic dataset with a mathematical averaging technique, wherein the mathematical averaging techniques includes arithmetic mean, a median, a geometric median, a mode, a geometric mean, a harmonic mean, a generalized mean, a moving average, or combination thereof;

generating a first measured valve position value for a closed position in response to one of the values of the dataset comprising a minimum value;

generating a second measured valve position value for an open position in response to one of the values of the dataset comprising a maximum value;

generating a first error value for the closed position by comparing the first measured valve position value to the valve position dataset; and generating a second error value for the open position by comparing the second measured valve position value to the valve position dataset.

8. The method of claim 7, wherein the result of the valve configuration process to which the operational indicator set is compared comprises the post-processing periodic dataset, the averaged value, the first measured valve position, the second measured valve position, the first error value, the second error value, or combination thereof.

9. The method of claim 8, wherein one or more of:

comparing the result of the valve configuration process to the operational indicator set, determining the pass/fail status of the valve configuration process based upon the comparison of the result of the valve configuration process and the operational indicator set, generating the incremental post-processing periodic dataset, generating the incremental averaged value for the incremental post-processing periodic dataset, generating the first measured valve position value and the second measure valve position, generating the generating a first error value for the closed position and the second error value for the open position is performed via the unit controller.

10. The method of claim 8, wherein one or more of:

comparing the result of the valve configuration process to the operational indicator set, determining the pass/fail status of the valve configuration process based upon the comparison of the result of the valve configuration process and the operational indicator set, generating the incremental post-processing periodic dataset, generating the incremental averaged value for the incremental post-processing periodic dataset, generating the first measured valve position value and the second measure valve position, generating the generating a first error value for the closed position and the second error value for the open position is performed via a network location.

11. The method of claim 10, further comprising:

transmitting the first periodic dataset, the first post-processing periodic dataset, the first averaged value for the first post-processing periodic dataset, or combinations thereof to the network location via a wireless communication protocol.

12. The method of claim 11, wherein the wireless communication protocol is at least one of a 5G, a long-term evolution (LTE), a code division multiple access (CDMA), or a global system for mobile communications (GSM) telecommunications protocol.

13. The method of claim 10, wherein the network location is one of i) a virtual network function (VNF) on a network slice within a 5G core network, ii) a VNF on a network slice within a 5G edge network, iii) a storage computer communicatively coupled to a network via a mobile communication network, or iv) a computer system communicatively coupled to the network via the mobile communication network.

14. The method of claim 13, wherein the network location comprises a database, a storage device, a remote computer system, a virtual computer system, a virtual network function, or combination thereof.

15. The method of claim 13, further comprising accessing, by a process executing on the network location, a historical database on the network location, the historical database comprising data associated with a plurality of pump units.

16. A wellbore servicing method comprising:

transporting a pump unit to a wellsite, the pump unit comprising unit controller configured to perform a valve configuration process, wherein the unit controller comprises a processor, a non-transitory memory, and an input output device:

fluidically connecting the pump unit to a wellhead;

establishing a flow loop providing a route of fluid communication via a supply pump, a flow control valve, and a flow rate sensor;

performing the valve configuration process, wherein the valve configuration process comprises:

positioning the flow control valve in a first position;

operating the supply pump to communicate a fluid via the flow loop at a first speed;

measuring, by the flow sensor, a first periodic dataset while the fluid is communicated via the flow loop with the flow control valve in the first position; and recording the first periodic dataset in memory, wherein the first periodic dataset is associated with the first speed of the supply pump and the first position of the flow control valve;

comparing a result of the valve configuration process to an operational indicator set;

configuring a flow control valve with the result of the valve configuration process by adjusting a valve position dataset from a first value to a second value in response to an error value, wherein the second value includes a measured valve position value;

determining a pass/fail status of one or more components of the pump unit based upon a comparison of the result of the valve configuration process and the operational indicator set; and where the pass/fail status of the one or more components of the pump unit is a passing status, pumping a wellbore treatment into the wellbore.

17. A system of wellbore pumping unit, comprising:

a wellbore pumping unit comprising a mixing system comprising a supply pump, a flow control valve, and a plurality of sensors;

a unit controller comprising a processor, a non-transitory memory, an interactive display, a system performance file, and a valve configuration process executing in memory, configured to:

establish a flow loop providing a route of fluid communication via the supply pump, the flow control valve, and a flow rate sensor, wherein the unit controller comprises a processor, a non-transitory memory, and an input output device;

perform a valve configuration process, wherein the valve configuration process comprises:

positioning the flow control valve in a first position;

operating the supply pump to communicate a fluid via the flow loop at a first speed;

measuring, by the flow sensor, a first periodic dataset while the fluid is communicated via the flow loop with the flow control valve in the first position; and recording the first periodic dataset in memory, wherein the first periodic dataset is associated with the first speed of the supply pump and the first position of the flow control valve;

generate an error value for the first valve position by comparing a result to a valve position dataset;

adjust the valve position dataset from a first value to a second value, wherein the second value includes the result;

compare the result of the valve configuration process to an operational indicator set, determine a pass/fail status of the mixing system based upon the comparison of the result of the valve configuration process and the operational indicator set; and output indicia of the pass/fail status of the mixing system via the input output device, wherein the pass/fail status of the mixing system a visual cue, and audible cue, or both.

18. The system of claim 17, wherein:

the sensors comprise a plurality of pressure sensors, a flowrate sensor, one or more valve position sensors, a tub level sensor, or combinations thereof.

19. The system of claim 17, further comprising a remote computer in communication with the unit controller via a wireless communication protocol.

20. The system of claim 19, wherein the wireless communication protocol is at least one of a 5G, a long-term evolution (LTE), a code division multiple access (CDMA), or a global system for mobile communications (GSM) telecommunications protocol.

21. The system of claim 17, wherein the wellbore pumping unit is a mud pump, a cement pumping unit, a blender unit, a water supply unit, or a fracturing pump.

* * * * *